US008993207B2

(12) United States Patent
Eida et al.

(10) Patent No.: US 8,993,207 B2
(45) Date of Patent: Mar. 31, 2015

(54) METHOD FOR FORMING FIXED IMAGES

(75) Inventors: Akihiro Eida, Wakayama (JP); Yasuhiro Hidaka, Kainan (JP)

(73) Assignee: Kao Corporation, Tokyo (JP)

( * ) Notice: Subject to any disclaimer, the term of this patent is extended or adjusted under 35 U.S.C. 154(b) by 2 days.

(21) Appl. No.: 13/822,667

(22) PCT Filed: Nov. 16, 2011

(86) PCT No.: PCT/JP2011/077104

§ 371 (c)(1),
(2), (4) Date: Mar. 13, 2013

(87) PCT Pub. No.: WO2012/077503

PCT Pub. Date: Jun. 14, 2012

(65) Prior Publication Data

US 2013/0183617 A1 Jul. 18, 2013

(30) Foreign Application Priority Data

Dec. 10, 2010 (JP) ..... 2010-276051
Apr. 5, 2011 (JP) ..... 2011-083643

(51) Int. Cl.
*G03G 9/08* (2006.01)
*G03G 9/087* (2006.01)

(52) U.S. Cl.
CPC ..... *G03G 9/08755* (2013.01); *G03G 9/0812* (2013.01); *G03G 9/08782* (2013.01)
USPC ..... 430/108.8; 430/109.4

(58) Field of Classification Search
CPC ..... G03G 9/08782; G03G 9/08755
USPC ..... 430/108.8, 109.4
See application file for complete search history.

(56) References Cited

U.S. PATENT DOCUMENTS

| | | | | |
|---|---|---|---|---|
| 5,384,224 | A | 1/1995 | Tanikawa et al. | |
| 7,799,500 | B2 | 9/2010 | Kobayashi et al. | |
| 2004/0229142 | A1 | 11/2004 | Dojo et al. | |
| 2006/0057484 | A1 | 3/2006 | Tsurumi et al. | |
| 2008/0131797 | A1 * | 6/2008 | Ishikawa et al. | 430/109.4 |
| 2008/0166647 | A1 | 7/2008 | Mang et al. | |

FOREIGN PATENT DOCUMENTS

| | | |
|---|---|---|
| EP | 1 467 259 A1 | 10/2004 |
| JP | 5-249735 | 9/1993 |

(Continued)

OTHER PUBLICATIONS

International Search Report issued Feb. 22, 2012, in international Application No. PCT/JP2011/077104.

*Primary Examiner* — Mark A Chapman
(74) *Attorney, Agent, or Firm* — Oblon, McClelland, Maier & Neustadt, L.L.P.

(57) ABSTRACT

A method for forming fixed images including the step of applying a toner for electrostatic image development containing at least a resin binder, a colorant, and a releasing agent to an apparatus for forming fixed images without a filter in a gas discharge part, wherein the resin binder contains a polyester, and wherein the releasing agent is a hydrocarbon-based wax, wherein the hydrocarbon-based wax has a melting point as determined by a differential scanning calorimeter of from 70° to 85° C., and contains components melting at a temperature equal to or lower than 65° C. having an amount of heat absorption as determined by a differential scanning calorimeter of less than 7.5 J/g, and a toner for electrostatic image development used in a method for forming fixed images. The method for forming fixed images of the present invention is suitably used in the development of a latent image formed in, for example, electrophotography, electrostatic recording method, electrostatic printing method or the like.

20 Claims, 1 Drawing Sheet

(56) References Cited

FOREIGN PATENT DOCUMENTS

| | | |
|---|---|---|
| JP | 6-230600 | 8/1994 |
| JP | 7-36218 | 2/1995 |
| JP | 9-80818 | 3/1997 |
| JP | 2006-78689 | 3/2006 |
| JP | 2007-206178 | 8/2007 |
| JP | 2010-139569 | 6/2010 |
| JP | 2010-139574 | 6/2010 |

* cited by examiner

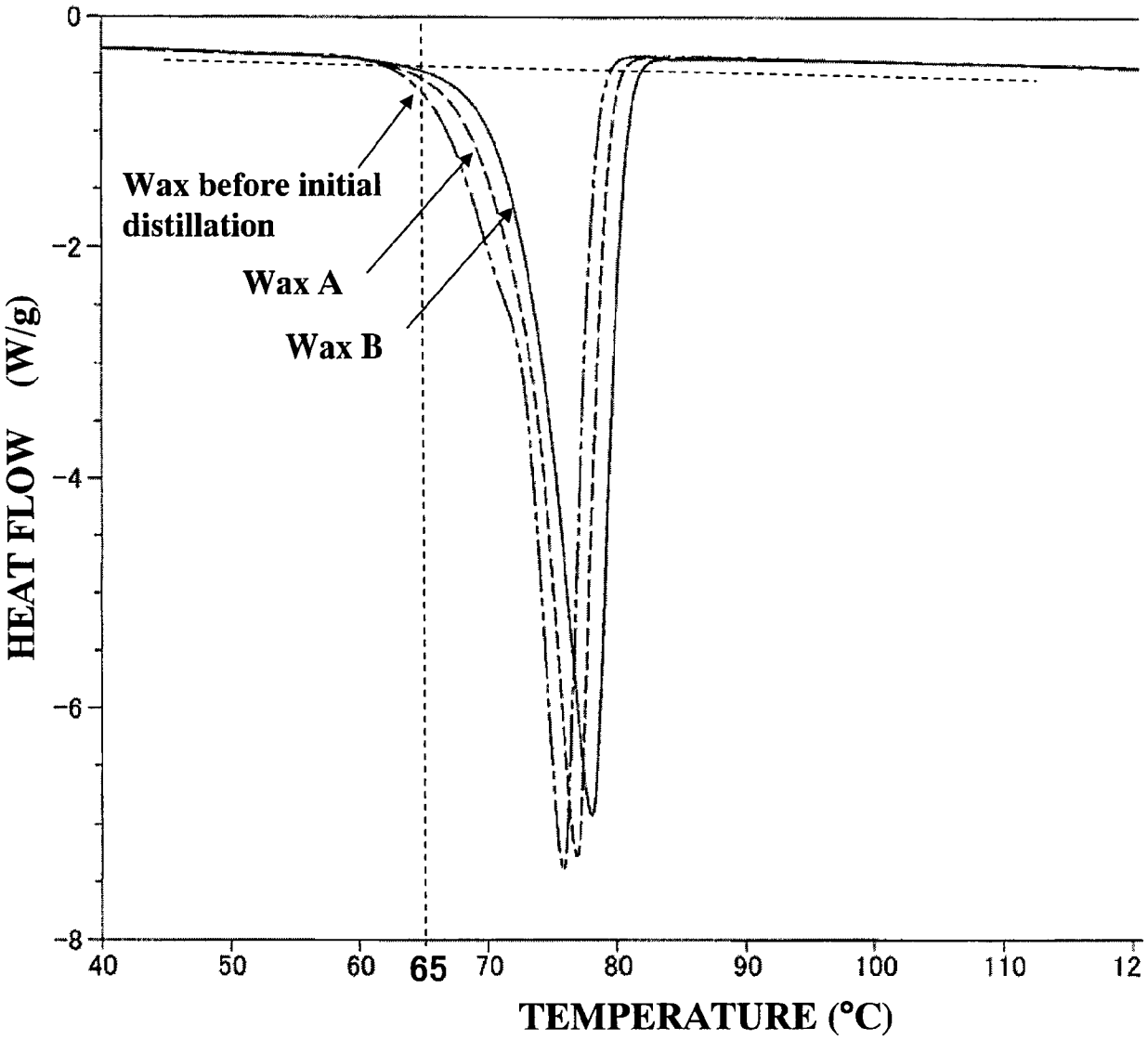
Wax before initial distillation
Wax A
Wax B
65
TEMPERATURE (°C)
HEAT FLOW (W/g)
0
-2
-4
-6
-8
40
50
60
70
80
90
100
110
12

METHOD FOR FORMING FIXED IMAGES

TECHNICAL FIELD

The present invention relates to a toner for electrostatic image development usable in developing latent images formed in, for example, electrophotography, an electrostatic recording method, an electrostatic printing method, or the like, and a method of forming fixed images using the toner.

BACKGROUND ART

Conventionally, in printers and copy machines, organic substances and the like that are generated from a toner upon fusing are captured with a filter in a gas exhaust part. In the recent years, there are increasing demands on miniaturization of apparatuses, and a miniaturized printer without a filter is desired in order to be effective in accomplishing miniaturization, cost reductions, and reduction in maintenance. If a toner or a toner-blended component is scattered in an apparatus without a filter in a gas exhaust part as mentioned above, it would cause soiling not only inside the apparatus for forming fixed images but also in the environment outside the apparatus. Therefore, it is desired in a miniaturized printer that organic substances which are generated from a toner are reduced.

Meanwhile, with the miniaturization of the apparatus and the speeding-up of the printing speed, the toner is required to have low-temperature fixing ability, and toners satisfying both low-temperature fixing ability and durability are numerously studied.

For example, it is disclosed that a toner for electrophotography containing a vegetable wax having an acid value of 3 mgKOH/g or less, which is at least one member selected from candelilla wax, carnauba wax, and rice wax can be fused at a low fusing temperature, and has no disadvantages caused for practical purposes in offset properties, and excellent fixing strength to an image-transferring sheet (see JP-A-Hei-6-230600).

In addition, it is disclosed that in a toner for electrostatic image development containing a resin binder and a hydrocarbon wax, the toner having specified storage modulus and loss modulus, and having a specified endothermic onset temperature at an endothermic peak, a specified temperature of endothermic peak, a specified temperature of exothermic peak, and a specified exothermic peak intensity ratio has excellent fixing ability, offset resistance, and blocking resistance (see JP-A-Hei-5-249735, corresponding to U.S. Pat. No. 5,384,224).

In addition, it is disclosed that a toner containing a colorant and a resin binder as main components, and a polyethylene wax having a melting peak temperature as determined by DSC in the range of from 70° to 120° C. without substantially containing a part having a melting point of 50° C. or lower, has excellent fixing ability, offset resistance, and covering strength (see JP-A-Hei-7-36218).

It is disclosed that in a method for forming fixed images including flash-fusing fixed images formed with plural toners having different infrared absorbent properties at a wavelength ranging from 800 to 1000 nm in a single step, wherein a toner having an average absorbance at a wavelength ranging from 800 to 1000 nm of less than 1.0 contains a polyolefin wax having Mn of from 500 to 2,000 and Mw/Mn of from 1.0 to 2.0, the toner having an average absorbance at a wavelength ranging from 800 to 1000 nm of 1.0 or more contains a polyolefin wax having Mn of from 2,500 to 10,000, so that any disadvantages ascribed to excessive fusing of a black toner are not caused (see JP-A-2006-78689).

It is disclosed that in a method for forming fixed images including fusing a toner image formed on an image supporting member by a toner containing a releasing agent having a specified kinematic viscosity at a fusing nip part of a fixing apparatus according to a contact-heating method, to give fixed images, the fixing temperature at a fixing nip portion is held in a state that is higher than a melting point of the releasing agent by 50° to 100° C., so that the generation of offset phenomena and image defects such as belt-shaped or line image defects is suppressed even when fusing takes place at a high speed, whereby favorable fixed images can be obtained (see JP-A-2007-206178, corresponding to U.S. Pat. No. 7,799,500).

SUMMARY OF THE INVENTION

The present invention relates to:

[1] a method for forming fixed images including the step of applying a toner for electrostatic image development containing at least a resin binder, a colorant, and a releasing agent to an apparatus for forming fixed images without a filter in a gas discharge part, wherein the resin binder contains a polyester, and wherein the releasing agent is a hydrocarbon-based wax, wherein the hydrocarbon-based wax has a melting point as determined by a differential scanning calorimeter of from 70° to 85° C., and contains components melting at a temperature equal to or lower than 65° C. having an amount of heat absorption as determined by a differential scanning calorimeter of less than 7.5 J/g; and

[2] a toner for electrostatic image development containing at least a resin binder, a colorant, and a releasing agent, wherein the resin binder contains a polyester, and wherein the releasing agent is a hydrocarbon-based wax, wherein the hydrocarbon-based wax has a melting point as determined by a differential scanning calorimeter of from 70° to 85° C., and contains components melting at a temperature equal to or lower than 65° C. having an amount of heat absorption as determined by a differential scanning calorimeter of less than 7.5 J/g, wherein the toner is applied to an apparatus for forming fixed images without a filter in a gas discharge part.

BRIEF DESCRIPTION OF THE DRAWINGS

FIG. 1 is a DSC chart upon heating for a wax before removal of initial distillate, Wax A, and Wax B, described in Production Examples 1 and 2 of Wax.

DETAILED DESCRIPTION OF THE INVENTION

An ester wax such as carnauba wax has excellent compatibility with a resin binder polyester, so that there is a disadvantage of having a poor high-temperature offset resistance.

In order to overcome this disadvantage, low-temperature fixing ability and high-temperature offset resistance can both be satisfied if a hydrocarbon wax having a lower compatibility with the polyester is used; however, there still remains a disadvantage on soiling inside the apparatus for forming fixed images due to scattering of a toner or a toner-blended component.

The present invention relates to a method for forming fixed images including applying a toner for electrostatic image development containing a polyester to an apparatus for forming fixed images without a filter in a gas exhaust part, the method being capable of suppressing soiling inside the machine, and a toner for electrostatic image development having excellent resistance to soiling in the machine, used in the above method for forming fixed images.

According to the present invention, soiling in the machine can be suppressed, even when the toner for electrostatic image development containing a polyester is applied to an apparatus for forming fixed images without a filter in a gas discharge part. Further, the toner for electrostatic image development of the present invention has not only excellent resistance to soiling in the machine, but also excellent low-temperature fixing ability and high-temperature offset resistance.

The method for forming fixed images of the present invention is a method including the step of applying, as a toner, a toner for electrostatic image development containing at least a resin binder, a colorant, and a releasing agent to an apparatus for forming fixed images without a filter in a gas discharge part, wherein the resin binder contains a polyester, and wherein the releasing agent is a hydrocarbon-based wax, wherein the hydrocarbon-based wax has a melting point as determined by a differential scanning calorimeter of from 70° to 85° C., and contains components melting at a temperature equal to or lower than 65° C. having an amount of heat absorption as determined by a differential scanning calorimeter of less than 7.5 J/g.

As a result of studying on a toner for electrostatic image development having excellent resistance to soiling in the machine, which can be used in an apparatus for forming fixed images without a filter in a gas discharge part, the present inventors have found that the toner of the present invention having the above features has excellent resistance to soiling in the machine. Although not wanting to be limited by theory, the reasons therefor are considered to be as follows.

In the present invention, in a toner containing a polyester, a hydrocarbon wax is used from the viewpoint of accelerating bleed-out to the surface of the toner particles in order to improve high-temperature offset resistance, and a wax having a low melting point is used in order to improve low-temperature fixing ability.

It is considered that the reasons why the soiling in the machine is reduced by controlling an amount of heat absorption of the components melting at a temperature of equal to lower than 65° C., which is a temperature below the lower limit of a melting point of a hydrocarbon wax, to less than 7.5 J/g, are in that a low-melting point component of the wax is causation of soiling in the machine, and the low-melting point component is reduced thereby. In other words, it is considered that a low-melting point component is reduced in a hydrocarbon wax having a specified melting point, and thereby resistance to soiling in the machine can be improved while maintaining low-temperature fixing ability and high-temperature offset resistance. Further, it is considered that a crystalline polyester is used in a resin binder, so that an increase in the temperature in the periphery of a fixing device is controlled by melting of the crystalline polyester, and thereby resistance to soiling in the machine is even more improved.

Further, it is considered that a composite resin described later is used as a crystalline polyester, so that dispersion of the hydrocarbon wax in the resin is improved, thereby even more improving resistance to soiling in the machine.

It is preferable that the resin binder of the toner of the present invention is composed of a crystalline resin and an amorphous resin, from the viewpoint of improvements in low-temperature fixing ability and high-temperature offset resistance of a toner and from the viewpoint of prevention of soiling by a toner in the machine. Here, the crystallinity of the resin is expressed by a crystallinity index defined by a ratio of a softening point to a temperature of the maximum endothermic peak determined with a differential scanning calorimeter, i.e., a value expressed by softening point/temperature of the maximum endothermic peak. The crystalline resin is a resin having a crystallinity index of from 0.6 to 1.4, preferably from 0.7 to 1.2, and more preferably from 0.9 to 1.2, and the amorphous resin is a resin having a crystallinity index of more than 1.4, or less than 0.6. The crystallinity of the resin can be adjusted by the kinds of the raw material monomers, a ratio thereof, production conditions (for example, reaction temperature, reaction time, cooling rate), and the like. Here, the temperature of maximum endothermic peak refers to a temperature of the peak on the higher temperature side among endothermic peaks observed. When a difference between the temperature of the maximum endothermic peak and the softening point is within 20° C., the temperature of the maximum endothermic peak is ascribed to a melting point. When the difference between the temperature of the maximum endothermic peak and the softening point exceeds 20° C., the peak is ascribed to a glass transition.

It is preferable that the crystalline resin is a crystalline polyester, from the viewpoint of improvement in low-temperature fixing ability of a toner.

The crystalline polyester is contained in an amount of preferably 80% by weight or more, more preferably 90% by weight or more, even more preferably 95% by weight or more, and even more preferably substantially 100% by weight, of the crystalline resin, from the viewpoint of improvement in low-temperature fixing ability of a toner.

The crystalline polyester is contained in an amount of preferably 5% by weight or more, more preferably 7% by weight or more, even more preferably 8% by weight or more, even more preferably 10% by weight or more, and even more preferably 15% by weight or more, of the resin binder, from the viewpoint of improvement in low-temperature fixing ability of a toner, and from the viewpoint of prevention of soiling by the toner in the machine. In addition, the crystalline polyester is contained in an amount of preferably 40% by weight or less, more preferably 35% by weight or less, even more preferably 30% by weight or less, and even more preferably 25% by weight or less, of the resin binder, from the viewpoint of improvements in high-temperature offset resistance and storage stability of a toner, and from the viewpoint of suppression of background fogging of a toner. Taken these viewpoints together, the crystalline polyester is contained in an amount of preferably from 5 to 40% by weight, more preferably from 7 to 35% by weight, even more preferably from 8 to 35% by weight, even more preferably from 10 to 30% by weight, even more preferably from 15 to 25% by weight, of the resin binder.

The crystalline polyester may contain a polyester component at least partly, and specifically, the crystalline polyester is preferably a crystalline composite resin (crystalline polyester A) containing a styrenic resin component and a polycondensation resin component obtained by polycondensing an alcohol component containing an aliphatic diol having 2 to 10 carbon atoms, and a carboxylic acid component containing an aromatic dicarboxylic acid compound; and a polyester (crystalline polyester B) obtained by polycondensing an alcohol component containing an aliphatic diol having 2 to 10 carbon atoms, and a carboxylic acid component. The crystalline polyester is more preferably a composite resin (crystalline polyester A), from the viewpoint of improvements in low-temperature fixing ability and high-temperature offset resistance of the toner, from the viewpoint of prevention of soiling by the toner in the machine, and from the viewpoint of suppression of background fogging of the toner.

The crystalline polyester A and the crystalline polyester B can be used alone or in a combination of two or more kinds. In addition, the crystalline polyester A and the crystalline polyester B may be used together.

In the present invention, it is preferable that the alcohol component of the polycondensation resin of the composite resin contains an aliphatic diol having 2 to 10 carbon atoms, preferably 4 to 8 carbon atoms, more preferably 4 to 6 carbon atoms, from the viewpoint of enhancement of crystallinity of the composite resin, from the viewpoint of improvement in low-temperature fixing ability of the toner, and from the viewpoint of prevention of soiling by the toner in the machine.

The aliphatic diol having 2 to 10 carbon atoms includes ethylene glycol, 1,2-propylene glycol, 1,3-propylene glycol, 1,4-butanediol, 1,5-pentanediol, 1,6-hexanediol, 1,7-heptanediol, 1,8-octanediol, 1,9-nonanediol, neopentyl glycol, 1,4-butenediol, and the like. The α,ω-linear alkanediol is preferred, 1,4-butanediol and 1,6-hexanediol are more preferred, and 1,6-hexanediol is even more preferred.

The aliphatic diol having 2 to 10 carbon atoms is contained in an amount of preferably 70% by mol or more, more preferably from 80 to 100% by mol, even more preferably from 90 to 100% by mol, and even more preferably substantially 100% by mol, of the alcohol component, from the viewpoint of enhancement of crystallinity of the composite resin and improvement in low-temperature fixing ability of the toner, and from the viewpoint of prevention of soiling by the toner in the machine. Here, a proportion of one kind of the aliphatic diol having 2 to 10 carbon atoms occupying the alcohol component is preferably 50% by mol or more, and more preferably from 60 to 100% by mol.

The alcohol component may contain a polyhydric alcohol component other than the aliphatic diol having 2 to 10 carbon atoms, and the polyhydric alcohol component includes aromatic diols such as an alkylene oxide adduct of bisphenol A, represented by the formula (I):

(I)

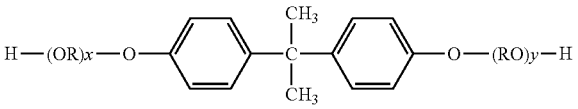

wherein RO and OR are an oxyalkylene group, wherein R is an ethylene and/or propylene group, x and y each shows the number of moles of the alkylene oxide added, each being a positive number, and the sum of x and y on average is preferably from 1 to 16, more preferably from 1 to 8, and even more preferably from 1.5 to 4; and trihydric or higher polyhydric alcohols such as glycerol, pentaerythritol, trimethylolpropane, sorbitol, and 1,4-sorbitan.

In the present invention, it is preferable that the carboxylic acid component of the polycondensation resin component contains an aromatic dicarboxylic acid compound, from the viewpoint of enhancement of crystallinity of the composite resin and improvement in low-temperature fixing ability of the toner, from the viewpoint of prevention of soiling by the toner in the machine of the toner, and from the viewpoint of suppression of background fogging of the toner.

The aromatic dicarboxylic acid compound is preferably aromatic dicarboxylic acids having 8 to 12 carbon atoms, such as phthalic acid, isophthalic acid, and terephthalic acid, and acid anhydrides thereof and alkyl (1 to 8 carbon atoms) esters thereof. Here, the dicarboxylic acid compound refers to a dicarboxylic acid, an acid anhydride thereof, and an alkyl (1 to 8 carbon atoms) ester thereof, among which the dicarboxylic acids are preferred. In addition, the preferred number of carbon atoms means the number of carbon atoms of the dicarboxylic acid moiety of the dicarboxylic acid compound.

The aromatic dicarboxylic acid compound is contained in an amount of preferably from 70 to 100% by mol, more preferably from 90 to 100% by mol, and even more preferably substantially 100% by mol, of the carboxylic acid component, from the viewpoint of enhancement of crystallinity of the composite resin and improvement in low-temperature fixing ability of a toner, from the viewpoint of prevention of soiling by the toner in the machine of the toner and from the viewpoint of suppression of background fogging of the toner.

The carboxylic acid component may contain a polycarboxylic acid compound other than the aromatic dicarboxylic acid compound. The polycarboxylic acid compound includes aliphatic dicarboxylic acids, such as oxalic acid, malonic acid, maleic acid, fumaric acid, citraconic acid, itaconic acid, glutaconic acid, succinic acid, adipic acid, and succinic acids substituted with an alkyl group having 1 to 30 carbon atoms or an alkenyl group having 2 to 30 carbon atoms; alicyclic dicarboxylic acids such as cyclohexanedicarboxylic acid; aromatic, tricarboxylic or higher polycarboxylic acids, such as trimellitic acid, 2,5,7-naphthalenetricarboxylic acid, and pyromellitic acid; acid anhydrides thereof, and alkyl(1 to 8 carbon atoms) esters thereof; and the like.

Here, the alcohol component may properly contain a monohydric alcohol, and the carboxylic acid component may properly contain a monocarboxylic acid compound, from the viewpoint of adjusting the molecular weight and the like.

Here, in the present specification, a dually reactive monomer described later is not counted to be included in the amount of the alcohol component or the carboxylic acid component contained.

The total number of moles of the aromatic dicarboxylic acid compound and the aliphatic diol having 2 to 10 carbon atoms is preferably from 75 to 100% by mol, more preferably from 85 to 100% by mol, and even more preferably from 95 to 100% by mol, of the total number of moles of the raw material monomers of the polycondensation resin component, i.e. the carboxylic acid component and the alcohol component, from the viewpoint of enhancement of crystallinity of the composite resin and improvement in low-temperature fixing ability of the toner, from the viewpoint of prevention of soiling by the toner in the machine of the toner, and from the viewpoint of suppression of background fogging of the toner.

As to the molar ratio of the carboxylic acid component to the alcohol component in the polycondensation resin component, i.e. carboxylic acid component/alcohol component, in order to achieve a larger molecular weight of the composite resin, it is preferable that the proportion of the alcohol component is greater than the carboxylic acid component, and the molar ratio is more preferably from 0.50 to 0.89, and even more preferably from 0.70 to 0.85.

The polycondensation reaction of the raw material monomers for the polycondensation resin component can be carried out in an inert gas atmosphere at a temperature of from 180° to 250° C. or so, optionally in the presence of an esterification catalyst, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification promoter that can be used together with the esterification catalyst includes gallic acid, and the like. The esterification catalyst is used in an amount of preferably from 0.01 to 1.5 parts by weight, and more preferably from 0.1 to 1.0 part by weight, based on 100 parts by weight of a total amount of the alcohol component, the carboxylic acid component, and the dually reactive monomer component. The esterification promoter is used in an amount of preferably from 0.001 to 0.5 parts by weight, and more preferably from 0.01 to 0.1 parts by weight, based on 100 parts by weight of a total amount of the alcohol component, the carboxylic acid component, and the dually reactive monomer component.

As the raw material monomers for the styrenic resin component, styrene or styrene derivatives such as α-methylstyrene and vinyltoluene (hereinafter, the styrene and styrene derivatives are collectively referred to as "styrenic derivatives") are used.

The styrenic derivative is contained in an amount of preferably 70% by weight or more, more preferably 80% by weight or more, and even more preferably 90% by weight or more, of the raw material monomers for the styrenic resin component, from the viewpoint of prevention of soiling by the toner in the machine, from the viewpoint of suppression of background fogging of the toner, and from the viewpoint of improvement in storage stability of the toner.

The raw material monomers for the styrenic resin component that are usable other than the styrenic derivative include alkyl (meth)acrylate ester; ethylenically unsaturated monoolefins, such as ethylene and propylene; diolefins such as butadiene; halovinyls such as vinyl chloride; vinyl esters such as vinyl acetate and vinyl propionate; ethylenically monocarboxylate esters such as dimethylaminoethyl (meth) acrylate; vinyl ethers such as vinyl methyl ether; vinylidene halides such as vinylidene chloride; N-vinyl compounds such as N-vinylpyrrolidone; and the like.

The raw material monomers for the styrenic resin component that are usable other than the styrenic derivative can be used in a combination of two or more kinds. The term "(meth) acrylic acid" as used herein means acrylic acid and/or methacrylic acid.

Among the raw material monomers for the styrenic resin component that are usable other than the styrenic derivative, the alkyl (meth)acrylate ester is preferred, from the viewpoint of improvement in low-temperature fixing ability of the toner. The alkyl group in the alkyl (meth)acrylate ester has preferably 1 to 22 carbon atoms, and more preferably 8 to 18 carbon atoms, from the viewpoint mentioned above. Here, the number of carbon atoms of the alkyl ester refers to the number of carbon atoms derived from the alcohol component moiety constituting the ester.

Specific examples of the alkyl (meth)acrylate ester includes methyl (meth)acrylate, ethyl (meth)acrylate, (iso) propyl (meth)acrylate, 2-hydroxyethyl (meth)acrylate, (iso or tert)butyl (meth)acrylate, 2-ethylhexyl (meth)acrylate, (iso) octyl (meth)acrylate, (iso)decyl (meth)acrylate, (iso)stearyl (meth)acrylate, and the like. Here, the expression "(iso or tert)" or "(iso)" embrace both a case where these groups are present and a case where the groups are absent, and the case where the groups are absent means normal. Also, the expression "(meth)acrylate" means that both cases of acrylate and methacrylate are included.

The alkyl (meth)acrylate ester is contained in an amount of preferably 30% by weight or less, more preferably 20% by weight or less, and even more preferably 10% by weight or less, of the raw material monomers for the styrenic resin component, from the viewpoint of prevention of soiling by the toner in the machine, from the viewpoint of suppression of background fogging of the toner, from the viewpoint of improvement in storage stability of the toner.

Here, a resin obtained by addition polymerization of raw material monomers containing a styrenic derivative and an alkyl (meth)acrylate ester is also referred to as styrene-(meth) acrylate resin.

The addition polymerization reaction of the raw material monomers for the styrenic resin component can be carried out by a conventional method, for example, a method of carrying out the reaction of the raw material monomers in the presence of a polymerization initiator such as dicumyl peroxide, a crosslinking agent, and the like in the presence of an organic solvent or in the absence of any solvents. The temperature conditions are preferably from 110° to 200° C., and more preferably from 140° to 170° C.

When an organic solvent is used upon the addition polymerization reaction, xylene, toluene, methyl ethyl ketone, acetone, or the like can be used. It is preferable that the organic solvent is used in an amount of from 10 to 50 parts by weight or so, based on 100 parts by weight of the raw material monomers for the styrenic resin component.

The styrenic resin component has a glass transition temperature (Tg) of preferably from 60° to 130° C., more preferably from 80° to 120° C., and even more preferably from 90° to 110° C., from the viewpoint of improvement in low-temperature fixing ability of the toner, and from the viewpoint of improvements in high-temperature offset resistance and storage stability of the toner.

As to Tg of the styrenic resin component, a value obtained by a calculation based on Tgn of a homopolymer of each of the monomers constituting each polymer, in accordance with Fox formula (T. G. Fox, *Bull. Am. Physics Soc.,* 1(3), 123 (1956)), an empirical formula for predicting Tg by a thermal additive formula in a case of a polymer, is used as calculated from the following formula (I):

$$1/Tg=\Sigma(Wn/Tgn) \quad (1)$$

wherein Tgn is Tg expressed in absolute temperature for a homopolymer of each of the monomer components; and Wn is a weight percentage of each of the monomer components.

The dually reactive monomer described later as used herein is assumed not to be counted in the calculation for the amount of the styrenic resin component contained, and not included in the calculation for Tg of the styrenic resin component.

In the calculation of the glass transition temperature (Tg) according to the Fox formula usable in Examples of the present invention, Tgn of styrene of 373K (100° C.) and Tgn of 2-ethylhexyl acrylate of 223K (−50° C.) are used.

It is preferable in the composite resin that the polycondensation resin component and the styrenic resin component are bonded directly or via a linking group. The linking group includes dually reactive monomers described later, compounds derived from chain transfer agents, and other resins, and the like.

The composite resin is preferably in a state that the polycondensation resin component and the styrenic resin component mentioned above are dispersed in each other, and the dispersion state mentioned above can be evaluated by a difference between Tg of the composite resin measured by the method described in Examples and a calculated value according to the above Fox formula.

In other words, while the composite resin in the present invention is a crystalline resin, the composite resin contains an amorphous portion derived from the styrenic resin component and the polycondensation resin component, so that the composite resin has a Tg ascribed to the styrenic resin component and a Tg ascribed to the polycondensation resin component. The Tg of the styrenic resin component and the Tg of the polycondensation resin component in the composite resin are values found separately. The higher the degree of dispersion of the styrenic resin component and the polycondensation resin component, the more approximate the both Tg values to each other; therefore, when the styrenic resin component and the polycondensation resin component are dispersed into a nearly homogenous state, both the Tg's overlap, and the found values would be nearly one.

Therefore, in the state where the styrenic resin component and the polycondensation resin component are dispersed in each other, the Tg of the composite resin measured under the measurement conditions described later takes a value different from a Tg calculated according to the Fox formula for the styrenic resin component mentioned above. Specifically, the absolute value of a difference in a glass transition temperature of the composite resin and a glass transition temperature of the styrenic resin component of the composite resin calculated according to Fox formula is preferably 10° C. or more, more preferably 30° C. or more, even more preferably 50° C. or more, and even more preferably 70° C. or more. In general, since the polycondensation resin component has a Tg lower than Tg of the styrenic resin component, the found values for the Tg of the composite resin may be lower than calculated values of Tg of the styrenic resin in many cases.

The composite resin as described above can, for example, be obtained by (1) a method including the step of polycondensing raw material monomers for a polycondensation resin component in the presence of a styrenic resin having a carboxyl group or a hydroxyl group, wherein the carboxyl group or the hydroxyl group includes those derived from a dually reactive monomer or a chain transfer agent described later; and (2) a method including the step of subjecting raw material monomers for a styrenic resin component to addition polymerization in the presence of a polycondensation resin having a reactive unsaturated bond; or the like.

It is preferable that the composite resin is a resin obtained from the raw material monomers for the polycondensation resin component and the raw material monomers for the styrenic resin component, and further a dually reactive monomer, capable of reacting with both of the raw material monomers for the polycondensation resin component and the raw material monomers for the styrenic resin component (hybrid resin), from the viewpoint of improvements in low-temperature fixing ability, high-temperature offset resistance, and storage stability of the toner, from the viewpoint of prevention of soiling by the toner in the machine, and from the viewpoint of suppression of background fogging of the toner. Therefore, upon the polymerization of the raw material monomers for the polycondensation resin component and the raw material monomers for the styrenic resin component to obtain a composite resin, it is preferable that the polycondensation reaction and/or the addition polymerization reaction is carried out in the presence of the dually reactive monomer. By inclusion of the dually reactive monomer, the composite resin is a resin formed by binding the polycondensation resin component and the styrenic resin component via a constituting unit derived from the dually reactive monomer (hybrid resin), in which the polycondensation resin component and the styrenic resin component are more finely and homogeneously dispersed.

Specifically, it is preferable that the composite resin is a resin obtained by polymerizing (i) raw material monomers for a polycondensation resin component, containing an alcohol component containing an aliphatic diol having 2 to 10 carbon atoms and a carboxylic acid component containing an aromatic dicarboxylic acid compound; (ii) raw material monomers for a styrenic resin component; and (iii) a dually reactive monomer capable of reacting with both of the raw material monomers for the polycondensation resin component and the raw material monomers for the styrenic resin component.

It is preferable that the dually reactive monomer is a compound having in its molecule at least one functional group selected from the group consisting of a hydroxyl group, a carboxyl group, an epoxy group, a primary amino group and a secondary amino group, preferably a carboxyl group and/or a hydroxyl group, and more preferably a carboxyl group, and an ethylenically unsaturated bond. By using the dually reactive monomer described above, dispersibility of the resin forming a dispersion phase can be even more improved. It is preferable that the dually reactive monomer is at least one member selected from the group consisting of acrylic acid, methacrylic acid, fumaric acid, maleic acid, and maleic anhydride. It is more preferable that the dually reactive monomer is acrylic acid, methacrylic acid, or fumaric acid, from the viewpoint of reactivities of the polycondensation reaction and the addition polymerization reaction. Here, in a case where a polymerization inhibitor is used together with the dually reactive monomer, a polycarboxylic acid having an ethylenically unsaturated bond, such as fumaric acid, functions as raw material monomers for the polycondensation resin component. In this case, fumaric acid or the like is not a dually reactive monomer but a raw material for a polycondensation resin component.

From the viewpoint of enhancement of dispersibility of the styrenic resin component and the polycondensation resin component, and improvements in low-temperature fixing ability, high-temperature offset resistance, and storage stability of the toner, from the viewpoint of prevention of soiling by the toner in the machine, and from the viewpoint of suppression of background fogging of the toner, the dually reactive monomer is used in an amount of preferably from 1 to 30 mol, more preferably from 2 to 25 mol, and even more preferably from 2 to 20 mol, based on 100 mol of a total of the alcohol component of the polycondensation resin component, and the dually reactive monomer is used in an amount of preferably from 2 to 30 mol, more preferably from 5 to 25 mol, and even more preferably from 10 to 20 mol, based on a total of 100 mol of the raw material monomers for the styrenic resin component, not including a polymerization initiator.

Specifically, it is preferable that a hybrid resin obtained by using a dually reactive monomer is produced by the following method. It is preferable that the dually reactive monomer is used in the addition polymerization reaction together with the raw material monomers for the styrenic resin component, from the viewpoint of improvements in low-temperature fixing ability, high-temperature offset resistance, and storage stability of the toner, from the viewpoint of prevention of soiling by the toner in the machine, and from the viewpoint of suppression of background fogging of the toner.

(i) Method including the steps of (A) carrying out a polycondensation reaction of raw material monomers for a polycondensation resin component; and thereafter (B) carrying out an addition polymerization reaction of raw materials monomers for a styrenic resin component and a dually reactive monomer In this method, the step (A) is carried out under reaction temperature conditions appropriate for a polycondensation reaction, a reaction temperature is then lowered, and the step (B) is carried out under temperature conditions appropriate for an addition polymerization reaction. It is preferable that the raw material monomers for the styrenic resin component and the dually reactive monomer are added to a reaction system at a temperature appropriate for an addition polymerization reaction. The dually reactive monomer also reacts with the polycondensation resin component as well as in the addition polymerization reaction.

After the step (B), a reaction temperature is raised again, raw material monomers for a polycondensation resin component such as a trivalent or higher polyvalent monomer serving as a crosslinking agent is optionally added to the polymerization system, whereby the polycondensation reaction of the step (A) and the reaction with the dually reactive monomer can be further progressed.

(ii) Method including the steps of (B) carrying out an addition polymerization reaction of raw material monomers for a styrenic resin component and a dually reactive monomer, and thereafter (A) carrying out a polycondensation reaction of raw material monomers for a polycondensation resin component In this method, the step (B) is carried out under reaction temperature conditions appropriate for an addition polymerization reaction, a reaction temperature is then raised, and the step (A) a polycondensation reaction is carried out under reaction temperature conditions appropriate for the polycondensation reaction. The dually reactive monomer is also involved in a polycondensation reaction as well as the addition polymerization reaction.

The raw material monomers for the polycondensation resin component may be present in a reaction system during the addition polymerization reaction, or the raw material monomers for the polycondensation resin component may be added to a reaction system under temperatures conditions appropriate for the polycondensation reaction. In the former case, the progress of the polycondensation reaction can be adjusted by adding an esterification catalyst at a temperature appropriate for the polycondensation reaction.

(iii) Method including the steps of concurrently carrying out the step (A) a polycondensation reaction of raw material monomers for a polycondensation resin component; and the step (B) an addition polymerization reaction of raw materials monomers for a styrenic resin component and a dually reactive monomer In this method, it is preferable that the steps (A) and (B) are carried out under reaction temperature conditions appropriate for an addition polymerization reaction, a reaction temperature is raised, raw material monomers for the polycondensation resin component of a trivalent or higher polyvalent monomer are optionally added to a polymerization system, and the polycondensation reaction of the step (A) is further carried out. During the process, the polycondensation reaction alone can also be progressed by adding a radical polymerization inhibitor under temperature conditions appropriate for the polycondensation reaction. The dually reactive monomer is also involved in a polycondensation reaction as well as the addition polymerization reaction.

In the above method (i), a polycondensation resin that is previously polymerized may be used in place of the step (A) of carrying out a polycondensation reaction. In the above method (iii), when the steps (A) and (B) are concurrently carried out, a mixture containing raw material monomers for the styrenic resin component can be added dropwise to a mixture containing raw material monomers for the polycondensation resin component to react.

It is preferable that the above methods (i) to (iii) are carried out in the same vessel, from the viewpoint of improvement in productivity of the composite resin.

In the composite resin, a weight ratio of the polycondensation resin component to the styrenic resin component [polycondensation resin component/styrenic resin component] (in the present invention, the weight ratio is defined as a weight ratio of the raw material monomers for the polycondensation resin component to the raw material monomers for the styrenic resin component), more specifically [a total weight of the raw material monomers for the polycondensation resin component/a total weight of the raw material monomers for the styrenic resin component], is preferably from 50/50 to 95/5, more preferably from 70/30 to 95/5, and even more preferably from 70/30 to 90/10, from the viewpoint of improvement in low-temperature fixing ability of the toner, from the viewpoint of improvements in high-temperature offset resistance and storage stability of the toner, from the viewpoint of prevention of soiling by the toner in the machine, and from the viewpoint of suppression of background fogging of the toner, by having the polycondensation resin as a continuous phase and the styrenic resin as a dispersed phase. Here, in the above calculation, the amount of the dually reactive monomer is included in the raw material monomers for the polycondensation resin component. In addition, the amount of the polymerization initiator is not included in the amount of the raw material monomers for a styrenic resin component.

In order to obtain a composite resin that has a large molecular weight, reaction conditions, such as adjustment of a molar ratio of the carboxylic acid component to the alcohol component as mentioned above, elevation of a reaction temperature, increase in the amount of a catalyst, and a dehydration reaction being carried out for a long period of time under a reduced pressure, may be selected. Here, a crystalline resin having a large molecular weight can also be produced by stirring a reaction raw material mixture with a high-output motor, and when a crystalline resin is produced without specifically selecting production facilities, a method including the step of reacting raw material monomers in the presence of a non-reactive low-viscosity resin and a solvent is also an effective means.

The composite resin (the crystalline polyester A) is contained in an amount of preferably 80% by weight or more, more preferably 90% by weight or more, even more preferably 95% by weight or more, and even more preferably substantially 100% by weight, of the crystalline polyester, from the viewpoint of improvements in low-temperature fixing ability, high-temperature offset resistance, storage stability, triboelectric charging stability of the toner, from the viewpoint of prevention of soiling by the toner in the machine, and from the viewpoint of suppression of background fogging of the toner.

The composite resin (the crystalline polyester A) is contained in an amount of preferably 5% by weight or more, more preferably 7% by weight or more, even more preferably 8% by weight or more, even more preferably 10% by weight or more, and even more preferably 15% by weight or more, of the resin binder, from the viewpoint of improvement in low-temperature fixing ability of the toner, and from the viewpoint of prevention of soiling by the toner in the machine. In addition, the composite resin is contained in an amount of preferably 40% by weight or less, more preferably 35% by weight or less, even more preferably 30% by weight or less, and even more preferably 25% by weight or less, of the resin binder, from the viewpoint of improvements in high-temperature offset resistance and storage stability of the toner, and from the viewpoint of suppression of background fogging of the toner. Taken these viewpoints together, the composite resin is contained in an amount of preferably from 5 to 40% by weight, more preferably from 7 to 35% by weight, even more preferably from 8 to 35% by weight, even more preferably from 10 to 30% by weight, and even more preferably from 15 to 25% by weight, of the resin binder.

The crystalline polyester B is obtained by polycondensing an alcohol component containing an aliphatic diol having 2 to 10 carbon atoms, and a carboxylic acid component.

As the alcohol component containing an aliphatic diol having 2 to 10 carbon atoms, the same ones as the alcohol component used in the polycondensation resin component of the composite resin mentioned above can be used.

The alcohol component of the crystalline polyester B may contain a polyhydric alcohol component other than the aliphatic diol having 2 to 10 carbon atoms, and those listed in the alcohol component used in the polycondensation resin component of the composite resin mentioned above can be used.

The carboxylic acid component of the crystalline polyester B include aromatic dicarboxylic acids, aliphatic dicarboxylic acids, and aromatic, tricarboxylic or higher polycarboxylic acids, and the like that are listed in the carboxylic acid component of the polycondensation resin component of the composite resin mentioned above.

Here, the alcohol component may properly contain a monohydric alcohol, and the carboxylic acid component may properly contain a monocarboxylic acid compound, from the viewpoint of adjusting the molecular weight and the like.

The crystalline polyester B is obtained by carrying out a polycondensation reaction in an inert gas atmosphere at a temperature of from 180° to 250° C. or so, optionally in the presence of an esterification catalyst, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification promoter that can be used together with the esterification catalyst includes gallic acid, and the like. The esterification catalyst is used in an amount of preferably from 0.01 to 1.5 parts by weight, and more preferably from 0.1 to 1.0 part by weight, based on 100 parts by weight of a total amount of the alcohol component and the carboxylic acid component. The esterification promoter is used in an amount of preferably from 0.001 to 0.5 parts by weight, and more preferably from 0.01 to 0.1 parts by weight, based on 100 parts by weight of a total amount of the alcohol component and the carboxylic acid component.

The crystalline polyester B is contained in an amount of preferably 80% by weight or more, more preferably 90% by weight or more, even more preferably 95% by weight or more, and even more preferably substantially 100% by weight, of the crystalline polyester, from the viewpoint of improvements in low-temperature fixing ability, high-temperature offset resistance, storage stability, and triboelectric charging stability of the toner, from the viewpoint of prevention of soiling by the toner in the machine, and from the viewpoint of suppression of background fogging of the toner.

The crystalline polyester B is contained in an amount of preferably 5% by weight or more, more preferably 7% by weight or more, even more preferably 8% by weight or more, even more preferably 10% by weight or more, and even more preferably 15% by weight or more, of the resin binder, from the viewpoint of improvement in low-temperature fixing ability and from the viewpoint of prevention of soiling by the toner in the machine. In addition, the crystalline polyester B is contained in an amount of preferably 40% by weight or less, more preferably 35% by weight or less, even more preferably 30% by weight or less, and even more preferably 25% by weight or less, of the resin binder, from the viewpoint of improvements in high-temperature offset resistance and storage stability of the toner, and from the viewpoint of suppression of background fogging of the toner. Taken these viewpoints together, crystalline polyester B is contained in an amount of preferably from 5 to 40% by weight, more preferably from 7 to 35% by weight, even more preferably from 8 to 35% by weight, even more preferably from 10 to 30% by weight, and even more preferably from 15 to 25% by weight, of the resin binder.

The crystalline polyester has a softening point of preferably 80° C. or higher, more preferably 100° C. or higher, and even more preferably 120° C. or higher, from the viewpoint of improvements in high-temperature offset resistance and storage stability of the toner, and from the viewpoint of prevention of soiling by the toner in the machine. In addition, the crystalline polyester has a softening point of preferably 160° C. or lower, more preferably 150° C. or lower, and even more preferably 140° C. or lower, from the viewpoint of improvement in low-temperature fixing ability of the toner. Taken these viewpoints together, the crystalline polyester has a softening point of preferably from 80° to 160° C., more preferably from 100° to 150° C., and even more preferably from 120° to 140° C.

In addition, the crystalline polyester has a melting point, i.e. a temperature of maximum endothermic peak, of preferably 80° C. or higher, more preferably 100° C. or higher, and even more preferably 120° C. or higher, from the viewpoint of improvements in high-temperature offset resistance and storage stability of the toner, and from the viewpoint of prevention of soiling by the toner in the machine. In addition, the crystalline polyester has a melting point of preferably 160° C. or lower, more preferably 150° C. or lower, and even more preferably 140° C. or lower, from the viewpoint of improvement in low-temperature fixing ability of the toner. Taken these viewpoints together, the crystalline polyester has a melting point of preferably from 80° to 160° C., more preferably from 100° to 150° C., and even more preferably from 120° to 140° C.

The softening point and the melting point of the crystalline polyester can be adjusted by controlling a raw material monomer composition, a polymerization initiator, a molecular weight, an amount of a catalyst, or the like, or selecting reaction conditions.

In addition, the composite resin has a Tg of preferably −10° C. or higher, more preferably −5° C. or higher, and even more preferably 0° C. or higher, from the viewpoint of improvements in high-temperature offset resistance and storage stability of the toner, and from the viewpoint of prevention of soiling by the toner in the machine. Also, the composite resin has a Tg of preferably 50° C. or lower, more preferably 40° C. or lower, and even more preferably 30° C. or lower, from the viewpoint of improvement in low-temperature fixing ability of the toner. Taken these viewpoints together, the composite resin has a Tg of preferably from −10° to 50° C., more preferably from −5° to 40° C., and even more preferably from 0° to 30° C.

In the amorphous resin in the present invention, a polyester, a vinyl resin, an epoxy resin, a polycarbonate, a polyurethane or the like may be used. It is preferable that the amorphous resin is a polyester obtained by polycondensing an alcohol component and a carboxylic acid component, from the viewpoint of improvements in low-temperature fixing ability and high-temperature offset resistance of the toner.

The amorphous polyester can also be produced by carrying out a polycondensation reaction of an alcohol component and a carboxylic acid component in an inert gas atmosphere at a temperature of from 180° to 250° C. or so, optionally in the presence of an esterification catalyst, a polymerization inhibitor or the like, in the same manner as in the polycondensation resin component of the composite resin.

In order to form an amorphous polyester, it is preferable to use a monomer for enhancing amorphization of the resin, in other words, an alkylene oxide adduct of bisphenol A in the alcohol component, and a succinic acid substituted with an alkyl group or an alkenyl group, and terephthalic acid in the carboxylic acid component.

In addition, it is preferable to use the above monomer in an amount of more preferably from 30 to 100% by mol, and even more preferably from 50 to 100% by mol, in at least one of the components, or preferably in each of both the components, of each of the alcohol component or carboxylic acid component.

The alkylene oxide adduct of bisphenol A is used in an amount of preferably from 50 to 100% by mol, more preferably from 70 to 100% by mol, and even more preferably from 95 to 100% by mol, of the alcohol component.

The succinic acid substituted with an alkyl group or an alkenyl group is used in an amount of preferably 50% by mol or less, more preferably 40% by mol or less, and even more preferably 30% by mol or less, of the carboxylic acid component.

Terephthalic acid is used in an amount of preferably from 30 to 100% by mol, more preferably from 40 to 95% by mol, and even more preferably from 50 to 95% by mol, of the carboxylic acid component.

In a case where a monomer for enhancing the crystallization of the resin, such as an aliphatic diol having 2 to 6 carbon atoms or an aliphatic carboxylic acid compound having 2 to 8 carbon atoms, is used, in order to form an amorphous polyester, it is preferable that these monomers are used in combination of two or more kinds to inhibit crystallization, in other words, in any of the alcohol component and the carboxylic acid component, one kind of these monomers is used in an amount of from 10 to 70% by mol, and preferably from 20 to 60% by mol of each component, and these monomers are used in two or more kinds, and more preferably two to four kinds.

The amorphous polyester has an acid value of preferably 30 mg KOH/g or less, more preferably 25 mg KOH/g or less, and even more preferably 20 mg KOH/g or less, from the viewpoint of improvement in transferability of the toner.

In the present invention, the amorphous polyester having a polyester component obtained by polycondensing an alcohol component and a carboxylic acid component not only contains the polyester but also a modified resin thereof.

The modified resin of the amorphous polyester includes, for example, a urethane-modified polyester in which an amorphous polyester is modified with a urethane bond, an epoxy-modified polyester in which an amorphous polyester is modified with an epoxy bond, a hybrid resin which is a composite of an amorphous polyester component and other resin component, and the like.

The amorphous polyester is contained in an amount of preferably 80% by weight or more, more preferably 90% by weight or more, even more preferably 95% by weight or more, and even more preferably substantially 100% by weight, of the amorphous resin, from the viewpoint of improvements in low-temperature fixing ability and high-temperature offset resistance of the toner.

The amorphous resin has a softening point of preferably 70° C. or higher, more preferably 90° C. or higher, and even more preferably 105° C. or higher, from the viewpoint of improvements in high-temperature offset resistance and storage stability of the toner, and from the viewpoint of prevention of soiling by the toner in the machine. In addition, the amorphous resin has a softening point of preferably 160° C. or lower, more preferably 140° C. or lower, and even more preferably 130° C. or lower, from the viewpoint of improvement in low-temperature fixing ability of the toner. Taken these viewpoints together, the amorphous resin has a softening point of preferably from 70° to 160° C., more preferably from 90° to 140° C., and even more preferably from 105° to 130° C.

In addition, the amorphous resin has a temperature of maximum endothermic peak of preferably 50° C. or higher, more preferably 55° C. or higher, and even more preferably 60° C. or higher, from the viewpoint of improvements in high-temperature offset resistance and storage stability of the toner, and from the viewpoint of prevention of soiling by the toner in the machine. In addition, the amorphous resin has a temperature of maximum endothermic peak of preferably 90° C. or lower, more preferably 80° C. or lower, and even more preferably 75° C. or lower, from the viewpoint of improvement in low-temperature fixing ability of the toner. Taken these viewpoints together, the amorphous resin has a temperature of maximum endothermic peak of preferably from 50° to 90° C., more preferably from 55° to 80° C., and even more preferably from 60° to 75° C.

The amorphous resin has a Tg of preferably 45° C. or higher, and more preferably 55° C. or higher, from the viewpoint of improvement in high-temperature offset resistance and storage stability of the toner, and from the viewpoint of prevention of soiling by the toner in the machine. In addition, the amorphous resin has a Tg of preferably 80° C. or lower, and more preferably 75° C. or lower, from the viewpoint of improvement in low-temperature fixing ability of the toner. Taken these viewpoints together, the amorphous resin has a Tg of preferably from 45° to 80° C., and more preferably from 55° to 75° C. Here, Tg is a physical property peculiarly shown in amorphous phases, and would be differentiated from a temperature of maximum endothermic peak.

In addition, in the present invention, the amorphous resin may contain two or more kinds of amorphous resins of which difference between softening points is preferably 3° C. or more, more preferably 5° C. or more, and even more preferably 10° C. or more, from the viewpoint of improvement in high-temperature offset resistance of the toner. Among the two or more kinds of the amorphous resins, a resin having the lowest softening point, i.e. low-softening point resin, has a softening point of preferably from 80° to 135° C., more preferably from 95° to 120° C., and even more preferably from 105° to 115° C., from the viewpoint of improvement in low-temperature fixing ability of the toner, and a resin having the highest softening point, i.e. high-softening point resin, has a softening point of preferably from 100° to 150° C., more preferably from 110° to 135° C., and even more preferably from 120° to 130° C., from the viewpoint of improvements in high-temperature offset resistance and storage stability of the toner. When the two or more kinds of the amorphous resins are contained, two kinds are preferred, from the viewpoint of improvement in productivity of the toner.

When the two kinds of the amorphous resins are used, a weight ratio of the high-softening point resin to the low-softening point resin, i.e. the high-softening point resin/the low-softening point resin, is preferably from 1/9 to 9/1, more preferably from 2/8 to 8/2, and even more preferably from 3/7 to 5/5, from the viewpoint of improvements in low-temperature fixing ability and high-temperature offset resistance.

The crystalline resin and the amorphous resin are contained in a ratio, i.e. the crystalline resin/the amorphous resin, as expressed by a weight ratio, of preferably from 5/95 to 50/50, more preferably from 7/93 to 40/60, even more preferably from 10/90 to 35/65, even more preferably from 15/85 to 30/70, and even more preferably from 15/85 to 25/75, from the viewpoint of improvements in low-temperature fixing ability and high-temperature offset resistance of the toner, from the viewpoint of prevention of soiling by the toner in the machine, and from the viewpoint of suppression of background fogging of the toner. The crystalline polyester and the amorphous polyester are contained in a ratio, i.e. the crystalline polyester/the amorphous polyester, as expressed by a weight ratio, of preferably from 5/95 to 50/50, more preferably from 7/93 to 40/60, even more preferably from 10/90 to 35/65, even more preferably from 15/85 to 30/70, and even more preferably from 15/85 to 25/75, from the same viewpoint. The crystalline polyester and the amorphous polyester are contained in a ratio, i.e. the crystalline polyester/the amorphous polyester, as expressed by a weight ratio, of preferably from 15/85 to 50/50, and more preferably from 25/75 to 50/50, from the viewpoint of improvement in low-temperature fixing ability of the toner and prevention of soiling by the toner in the machine. The crystalline polyester and the amorphous polyester are contained in a ratio, i.e. the crystalline polyester/the amorphous polyester, as expressed by a weight ratio, of preferably from 5/95 to 25/75, and more preferably from 5/95 to 15/85, from the viewpoint of improvement in high-temperature offset resistance of the toner, and from the viewpoint of suppression of background fogging of the toner.

In addition, the composite resin (the crystalline polyester A) and the amorphous polyester are contained in a total amount of preferably 80% by weight or more, more preferably 90% by weight or more, even more preferably 95% by weight or more, and even more preferably substantially 100% by weight, of the resin binder, from the viewpoint of prevention of soiling by the toner in the machine.

Further, the composite resin (the crystalline polyester A) and the amorphous polyester are contained in a ratio, i.e. the composite resin/the amorphous polyester, as expressed by a weight ratio, of preferably from 15/85 to 50/50, and more preferably from 25/75 to 50/50, from the viewpoint of low-temperature fixing ability of the toner and prevention of soiling by the toner in the machine, and the composite resin (the crystalline polyester A) and the amorphous polyester are contained in a ratio, i.e. the composite resin/the amorphous polyester, as expressed by a weight ratio, of preferably from 5/95 to 25/75, and more preferably from 5/95 to 15/85, from the viewpoint of improvement in high-temperature offset resistance of the toner and from the viewpoint of suppression of background fogging of the toner. In addition, the composite resin (the crystalline polyester A) and the amorphous polyester are contained in a ratio, i.e. the composite resin/the amorphous polyester, as expressed by a weight ratio, of preferably from 5/95 to 50/50, more preferably from 7/93 to 40/60, even more preferably from 10/90 to 35/65, even more preferably from 15/85 to 30/70, and even more preferably from 15/85 to 25/75, from the viewpoint of improvements in low-temperature fixing ability and high-temperature offset resistance of the toner, from the viewpoint of prevention of soiling by the toner in the machine, and from the viewpoint of suppression of background fogging of the toner.

As the colorant, all of the dyes, pigments and the like which are used as colorants for toners can be used, and specifically, carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. The colorant is contained in an amount of preferably from 1 to 40 parts by weight, and more preferably from 2 to 10 parts by weight, based on 100 parts by weight of the resin binder, from the viewpoint of improvement in an optical density. The toner of the present invention may be any of black toners and color toners.

The releasing agent is a hydrocarbon wax, from the viewpoint of improvements in low-temperature fixing ability and high-temperature offset resistance of the toner. Specific examples thereof include low-molecular weight polypropylenes, low-molecular weight polyethylenes, low-molecular weight polypropylene-polyethylene copolymers, microcrystalline waxes, paraffinic waxes, and Fischer-Tropsch wax, and the like, and the paraffinic waxes are preferred, from viewpoint of improvement in low-temperature fixing ability of the toner.

The hydrocarbon wax has a melting point, as determined by a differential scanning calorimeter, of 70° C. or higher, preferably 72° C. or higher, and more preferably 75° C. or higher, from the viewpoint of improvement in high-temperature offset resistance of the toner, from the viewpoint of prevention of soiling by the toner in the machine, and from the viewpoint of suppression of background fogging of the toner. In addition, the hydrocarbon wax has a melting point of 85° C. or lower, preferably 82° C. or lower, and more preferably 80° C. or lower, from the viewpoint of improvement in low-temperature fixing ability of the toner. Taken these viewpoints together, the hydrocarbon wax has a melting point of from 70° to 85° C., preferably from 72° to 82° C., and more preferably from 75° to 80° C. Here, the melting point of the hydrocarbon wax as determined by a differential scanning calorimeter is measured by a method described in Examples set forth below.

The melting point of the hydrocarbon wax can be raised by increasing its molecular weight or increasing a proportion of normal paraffin. The melting point can be lowered by decreasing its molecular weight or lowering a proportion of normal paraffin.

The hydrocarbon wax has a number-average molecular weight of preferably 660 or more, more preferably 700 or more, even more preferably 720 or more, and even more preferably 730 or more, from the viewpoint of improvement in high-temperature offset resistance of the toner, from the viewpoint of prevention of soiling by the toner in the machine, and from the viewpoint of suppression of background fogging of the toner. In addition, the hydrocarbon wax has a number-average molecular weight of preferably 850 or less, more preferably 800 or less, even more preferably 780 or less, and even more preferably 770 or less, from the viewpoint of improvements in low-temperature fixing ability and high-temperature offset resistance. Taken these viewpoints together, the hydrocarbon wax has a number-average molecular weight of preferably from 660 to 850, more preferably from 700 to 800, even more preferably from 720 to 780, and even more preferably from 730 to 770.

Also, the hydrocarbon wax has a weight-average molecular weight of preferably 700 or more, more preferably 750 or more, even more preferably 770 or more, and even more preferably 780 or more, from the viewpoint of improvement in high-temperature offset resistance of the toner, from the viewpoint of prevention of soiling by the toner in the machine, and from the viewpoint of suppression of background fogging of the toner. In addition, the hydrocarbon wax has a weight-average molecular weight of preferably 900 or less, more preferably 850 or less, even more preferably 820 or less, and even more preferably 810 or less, from the viewpoint of improvements in low-temperature fixing ability and high-temperature offset resistance. Taken these viewpoints together, the hydrocarbon wax has a weight-average molecular weight of preferably from 700 to 900, more preferably from 750 to 850, even more preferably from 770 to 820, and even more preferably from 780 to 810.

Here, the number-average molecular weight and the weight-average molecular weight of the hydrocarbon wax are measured by methods described in Examples set forth below.

The amount of heat absorption of the components of the hydrocarbon wax melting at a temperature of equal to or lower than 65° C., as determined by a differential scanning calorimeter, is less than 7.5 J/g, preferably 5.0 J/g or less, more preferably 4.0 J/g or less, and even more preferably 3.0 J/g or less, from the viewpoint of prevention of soiling by the toner in the machine, and from the viewpoint of suppression of background fogging of the toner. Here, the amount of heat absorption of the components of the hydrocarbon wax melting at a temperature of equal to or lower than 65° C., as determined by a differential scanning calorimeter, is measured by a method described in Examples set forth below.

The amount of heat absorption of the components of the hydrocarbon wax melting at a temperature of equal to or lower than 65° C., as determined by a differential scanning calorimeter, can be reduced, for example, by distilling a commercially available hydrocarbon wax according to a boiling-point separation method to remove an initial distillate.

In the boiling-point separation method of the hydrocarbon wax, although an ordinary distillation apparatus can be used, it is preferable to use a centrifugal molecular distillation apparatus, a thin film distillation apparatus or the like, that is provided with high-vacuum and high-temperature equipments, from the viewpoint of prevention of the degradation of the hydrocarbon wax by heat.

In the boiling-point separation method, the conditions for a degree of vacuum are preferably 3.0 Pa or less, and more preferably 1.0 Pa or less, from the viewpoint of reduction in an amount of heat absorption of the components melting at a temperature of equal to or lower than 65° C., and prevention of soiling by the toner in the machine, and from the viewpoint of suppression of background fogging of the toner. In addition, the conditions for a degree of vacuum are preferably 0.01 Pa or more, and more preferably 0.05 Pa or more, from the viewpoint of controlling a melting point within a given range. Taken these viewpoints together, the conditions for a degree of vacuum are preferably from 0.01 to 3.0 Pa, and more preferably from 0.05 to 1.0 Pa.

In the boiling-point separation method, the treatment temperature is preferably 170° C. or higher, and more preferably 190° C. or higher, from the viewpoint of reduction in an amount of heat absorption of the components melting at a temperature of 65° C. or lower, and prevention of soiling by the toner in the machine, and from the viewpoint of suppression of background fogging of the toner. In addition, the treatment temperature is preferably 300° C. or lower, and more preferably 290° C. or lower, from the viewpoint of control of a melting point within a given range. Taken these viewpoints together, the treatment temperature is preferably from 170° to 300° C., and more preferably from 190° to 290° C.

The hydrocarbon wax is contained in the toner in an amount of preferably 1.0 part by weight or more, more preferably 2.0 parts by weight or more, and even more preferably 4.0 parts by weight or more, based on 100 parts by weight of the resin binder, from the viewpoint of improvements in low-temperature fixing ability and high-temperature offset resistance of the toner. In addition, the hydrocarbon wax is contained in the toner in an amount of preferably 8.0 parts by weight or less, more preferably 7.0 parts by weight or less, and even more preferably 6.0 parts by weight or less, based on 100 parts by weight of the resin binder, from the viewpoint of prevention of soiling by the toner in the machine, and from the viewpoint of suppression of background fogging of the toner. Taken these viewpoints together, the hydrocarbon wax is contained in the toner in an amount of preferably from 1.0 to 8.0 parts by weight, more preferably from 2.0 to 7.0 parts by weight, and even more preferably from 4.0 to 6.0 parts by weight, based on 100 parts by weight of the resin binder.

Here, the releasing agent used in the present invention may contain a releasing agent other than the hydrocarbon wax, within the range so as not to impair the effects of the present invention. It is preferable that the releasing agent other than the hydrocarbon wax has a melting point as determined by a differential scanning calorimeter, and contains components melting at a temperature of 65° C. or lower having an amount of heat absorption as determined by a differential scanning calorimeter, both the melting point and the amount of heat absorption within the ranges mentioned above.

The toner of the present invention may contain a charge control agent, and the like, aside from the resin binder, the colorant, and the releasing agent.

The charge control agent is not particularly limited. The negatively chargeable charge control agent includes metal-containing azo dyes, for example, "BONTRON S-28" (commercially available from Orient Chemical Co., Ltd.), "T-77" (commercially available from Hodogaya Chemical Co., Ltd.), "BONTRON S-34" (commercially available from Orient Chemical Co., Ltd.), "AIZEN SPILON BLACK TRH" (commercially available from Hodogaya Chemical Co., Ltd.), and the like; copper phthalocyanine dyes; metal complexes of alkyl derivatives of salicylic acid, for example, "BONTRON E-81," "BONTRON E-84," "BONTRON E-304" (hereinabove commercially available from Orient Chemical Co., Ltd.), and the like; nitroimidazole derivatives; boron complexes of benzilic acid, for example, "LR-147" (commercially available from Japan Carlit, Ltd.); nonmetallic charge control agents, for example, "BONTRON F-21," "BONTRON E-89" (hereinabove commercially available from Orient Chemical Co., Ltd.), "T-8" (commercially available from Hodogaya Chemical Co., Ltd.), "FCA-2521NJ," "FCA-2508N" (hereinabove commercially available from FUJIKURA KASEI CO., LTD.), and the like.

The positively chargeable charge control agent includes Nigrosine dyes, for example, "BONTRON N-01," "BONTRON N-04," "BONTRON N-07" (hereinabove commercially available from Orient Chemical Co., Ltd.), "CHUO CCA-3" (commercially available from CHUO GOUSEI KAGAKU CO., LTD.), and the like; triphenylmethane-based dyes containing a tertiary amine as a side chain; quaternary ammonium salt compounds, for example, "BONTRON P-51" (commercially available from Orient Chemical Co., Ltd.), "TP-415" (commercially available from Hodogaya Chemical Co., Ltd.), cetyltrimethylammonium bromide, "COPY CHARGE PX VP435" (commercially available from Clariant Japan, Ltd.); and the like.

The charge control agent is contained in an amount of preferably 0.1 parts by weight or more, and more preferably 0.2 parts by weight or more, based on 100 parts by weight of the resin binder, from the viewpoint of improvement in triboelectric charging stability of the toner. In addition, the charge control agent is contained in an amount of preferably 5 parts by weight or less, and more preferably 3 parts by weight or less, based on 100 parts by weight of the resin binder, from the viewpoint of adjustment of triboelectric charges of the toner to an appropriate level to provide improvement in developability. In other words, taken these viewpoints together, the charge control agent is contained in an amount of preferably from 0.1 to 5 parts by weight, and more preferably from 0.2 to 3 parts by weight, based on 100 parts by weight of the resin binder.

The toner of the present invention may further properly contain an additive such as a magnetic particulate, a fluidity improver, an electric conductivity modifier, an extender pigment, a reinforcing filler such as a fibrous material, an anti-oxidant, an anti-aging agent, or a cleanability improver.

The toner of the present invention may be a toner obtained by any of conventionally known methods such as a melt-kneading method, an emulsion aggregation method, and a polymerization method, and a pulverized toner produced by the melt-kneading method is preferred, from the viewpoint of productivity and colorant dispersibility. Specifically, the toner can be produced by homogeneously mixing raw materials such as a resin binder, a colorant, a charge control agent and a releasing agent with a mixer such as a Henschel mixer, thereafter melt-kneading the mixture, cooling, pulverizing, and classifying the product. On the other hand, a toner produced by the polymerization method or the emulsion aggregation method is preferred from the viewpoint of the production of toners having smaller particle sizes.

The melt-kneading of the raw materials can be carried out with a known kneader, such as a closed kneader, a single-screw or twin-screw extruder, or a continuous open-roller type kneader. Since the additives can be efficiently highly dispersed in the resin binder without repeats of kneading or without a dispersion aid, a continuous open-roller type kneader provided with feeding ports and a discharging port for a kneaded product along the shaft direction of the roller is preferably used.

It is preferable that the raw materials for a toner are previously homogeneously mixed with a Henschel mixer, a Super-Mixer or the like, and thereafter fed to an open-roller type kneader, and the raw materials may be fed from one feeding port, or dividedly fed to the kneader from plural feeding ports. It is preferable that the raw materials for the toner are fed to the kneader from one feeding port, from the viewpoint of easiness of operation and simplification of an apparatus.

The continuous open-roller type kneader refers to a kneader of which kneading member is an open type, not being tightly closed, and the kneading heat generated during the kneading can be easily dissipated. In addition, it is desired that the continuous open-roller type kneader is a kneader provided with at least two rollers. The continuous open-roller type kneader used in the present invention is a kneader provided with two rollers having different peripheral speeds, in other words, two rollers of a high-rotation roller having a high peripheral speed and a low-rotation roller having a low peripheral speed. In the present invention, it is desired that the high-rotation roller is a heat roller, and the low-rotation roller is a cooling roller, from the viewpoint of improvement in dispersibility of the raw materials for a toner, such as a colorant and a releasing agent, in the resin binder.

The temperature of the roller can be adjusted by, for example, a temperature of a heating medium passing through the inner portion of the roller, and each roller may be divided in two or more portions in the inner portion of the roller, each being communicated with heating media of different temperatures.

The temperature at the end part of the raw material supplying side of the high-rotation roller is preferably from 100° to 160° C., and the temperature at the end part of the raw material supplying side of the low-rotation roller is preferably from 35° to 100° C.

In the high-rotation roller, the difference between a setting temperature at the end part of the raw material supplying side and a setting temperature at the end part of the kneaded product discharging side is preferably from 20° to 60° C., more preferably from 20° to 50° C., and even more preferably from 30° to 50° C., from the viewpoint of prevention in detachment of the kneaded product from the roller. In the low-rotation roller, the difference between a setting temperature at the end part of the raw material supplying side and a setting temperature at the end part of the kneaded product discharging side is preferably from 0° to 50° C., more preferably from 0° to 40° C., and even more preferably from 0° to 20° C., from the viewpoint of improvement in dispersibility of the raw materials for a toner, such as a colorant and a releasing agent, in the resin binder.

The peripheral speed of the high-rotation roller is preferably from 2 to 100 m/min, and more preferably from 5 to 75 m/min. The peripheral speed of the low-rotation roller is preferably from 1 to 90 m/min, more preferably from 2 to 60 m/min, and even more preferably from 4 to 50 m/min. In addition, the ratio between the peripheral speeds of the two rollers, i.e., low-rotation roller/high-rotation roller, is preferably from 1/10 to 9/10, and more preferably from 3/10 to 8/10.

Structures, size, materials and the like of the roller are not particularly limited. Also, the surface of the roller may be any of smooth, wavy, rugged, or other surfaces. In order to increase kneading share, it is preferable that plural spiral ditches are engraved on the surface of each roller.

The toner has a volume-median particle size ($D_{50}$) of preferably from 3.0 to 12 μm, more preferably from 3.5 to 10 μm, and even more preferably from 4 to 9 μm, from the viewpoint of improvement in the image quality of the toner. The term "volume-median particle size ($D_{50}$)" as used herein means a particle size of which cumulative volume frequency calculated on a volume percentage is 50% counted from the smaller particle sizes.

In the toner of the present invention, it is preferable that fine inorganic particles are used as an external additive for improving transferablility. Specific examples of the external additive include inorganic particles of silica, alumina, titania, zirconia, tin oxide, and zinc oxide, and fine organic particles such as resin particles, such as fine melamine resin particles and fine polytetrafluoroethylene resin particles. Among them, silica is preferred, and it is more preferable to contain a silica having a small specific gravity, from the viewpoint of prevention of the silica from embedment into the resin binder.

The silica is preferably a hydrophobic silica that is hydrophobically treated, from the viewpoint of improvement in transferability of the toner.

The hydrophobic treatment agent for hydrophobically treating the surface of silica particles is exemplified by organochlorosilane, organoalkoxysilane, organodisilazane, cyclic organopolysilazane, linear organopolysiloxane and the like, and specifically include hexamethyldisilazane (HMDS), dimethyldichlorosilane (DMDS), a silicone oil, octyltriethoxysilane (OTES), methyltriethoxysilane, and the like. Among them, hexamethyldisilazane is preferred.

The external additive has an average primary particle size of preferably from 10 to 250 nm, more preferably from 10 to 200 nm, and even more preferably from 15 to 90 nm, from the viewpoint of improvements in triboelectric chargeability, flowability, and transferability of the toner.

It is preferable that two or more kinds of silicas having different average particle sizes are used together, and it is more preferable that a silica having an average particle size of less than 20 nm and a silica having an average particle size of 20 nm or more are used together, from the viewpoint of improvements in triboelectric chargeability, flowability, and transferability of the toner.

The external additive is contained in an amount of preferably from 0.05 to 5 parts by weight, more preferably from 0.1 to 4 parts by weight, and even more preferably from 0.3 to 3 parts by weight, based on 100 parts by weight of the toner before the treatment with the external additive, from the viewpoint of improvements in triboelectric chargeability, flowability, and transferability of the toner.

The toner of the present invention, as mentioned above, is used for an apparatus for forming fixed images without a filter in a gas discharge part. The apparatus for forming fixed images, as mentioned above, is not particularly limited in the development method and the fusing method, so long as the apparatus for forming fixed images is without a filter in a gas discharge part.

The development method for the apparatus for forming fixed images used in the present invention may be either a monocomponent development in which a toner is directly used, or a two-component development using a two-component developer containing a toner mixed with a carrier, and an apparatus for forming fixed images according to a nonmagnetic monocomponent development can also be suitably used, from the viewpoint of making it suitable to be used in an apparatus for fixed images which is not provide with a filter in a gas discharge part.

In addition, the fusing method is not particularly limited, and an apparatus for forming fixed images according to an oil-less fusing method can be suitably used. Here, the oil-less fusing refers to a method in which a fixing apparatus having a heat roller fixing apparatus without being equipped with an oil feeding device is used. The oil feeding device encompasses a device having an oil tank, and a mechanism in which an oil is applied in a given amount to a heat roller surface, and a device having a mechanism in such a manner that a roller previously immersed in an oil is contacted with a heat roller, and the like.

Therefore, as the apparatus for forming fixed images of the present invention, an apparatus for forming fixed images according to an oil-less fusing method and a nonmagnetic monocomponent development method can also be suitably used.

Further, an apparatus for forming fixed images of the present invention that requires speeding-up and miniaturization, such as a full-color printer or a full-color copy machine, can also be suitably used, from the viewpoint of having excellent low-temperature fixing ability and high-temperature offset resistance.

EXAMPLES

The following examples further describe and demonstrate embodiments of the present invention. The examples are given solely for the purposes of illustration and are not to be construed as limitations of the present invention.

[Softening Points of Resins]

The softening point refers to a temperature at which half of the sample flows out, when plotting a downward movement of a plunger of a flow tester (commercially available from Shimadzu Corporation, CAPILLARY RHEOMETER "CFT-500D"), against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

[Temperature of Maximum Endothermic Peak and Melting Point of Resin]

Measurements were taken using a differential scanning calorimeter ("Q-100," commercially available from TA Instruments, Japan), by cooling a 0.01 to 0.02 g sample weighed out in an aluminum pan from room temperature to 0° C. at a cooling rate of 10° C./min, allowing the cooled sample to stand for 1 minute, and thereafter heating the sample at a rate of 50° C./min. Among the endothermic peaks observed, the temperature of an endothermic peak on the highest temperature side is defined as a temperature of maximum endothermic peak. When a difference between the temperature of maximum endothermic peak and the softening point is within 20° C., the temperature of maximum endothermic peak is defined as a melting point.

[Glass Transition Temperatures of Amorphous Resins]

Measurements were taken using a differential scanning calorimeter ("Q-100," commercially available from TA Instruments, Japan), by heating a 0.01 to 0.02 g sample weighed out in an aluminum pan to 200° C. at a rate of 10° C./min. A temperature of an intersection of the extension of the baseline of equal to or lower than the temperature of maximum endothermic peak and the tangential line showing the maximum inclination between the kick-off of the peak and the top of the peak in the above measurement is defined as a glass transition temperature.

[Glass Transition Temperatures of Crystalline Polyester (Composite Resin)]

Measurements were taken using a differential scanning calorimeter ("Q-100," commercially available from TA Instruments, Japan) in a modulated mode, by heating a 0.01 to 0.02 g sample weighed out in an aluminum pan to 200° C., cooling the sample from that temperature to −80° C. at a cooling rate of 100° C./min, and raising the temperature of the sample at a rate of 1° C./min. A temperature of an intersection of the extension of the baseline of equal to or lower than the temperature of maximum endothermic peak and the tangential line showing the maximum inclination between the kick-off of the peak and the top of the peak in reverse heat flow curve of the above measurement is defined as a glass transition temperature.

[Acid Value of Resin]

The acid value is determined by a method according to JIS K0070 except that only the determination solvent is changed from a mixed solvent of ethanol and ether as defined in JIS K0070 to a mixed solvent of acetone and toluene (volume ratio of acetone:toluene=1:1).

[Melting Point of Releasing Agent]

A temperature of maximum endothermic peak of the heat of fusion obtained by raising the temperature of a sample to 200° C., cooling the sample from this temperature to 0° C. at a cooling rate of 10° C./min, and thereafter raising the temperature of the sample at a heating rate of 10° C./min, using a differential scanning calorimeter ("DSC 210," commercially available from Seiko Instruments, Inc.) is referred to as a melting point.

[Number-Average Molecular Weight and Weight-Average Molecular Weight of Releasing Agent]

The number-average molecular weight and the weight-average molecular weight are measured according to gel permeation method. The measurement conditions are as follows.

Measurement Apparatus: HLC-8220GPC (commercially available from Tosoh Corporation)

Analyzing Column: GMHXL+G3000HXL (commercially available from Tosoh Corporation)

Column Temperature: The column is stabilized in a thermostat at 40° C.

Eluate: Tetrahydrofuran

Flow Rate: 1 ml/minute

Sample Concentration: 1 mg/ml

Sample Solution: 100 μl

Calibration Curve: The calibration curve is drawn using monodisperse polystyrenes (A-500 ($5.0\times10^2$), A-1000 ($1.01\times10^3$), A-2500 ($2.63\times10^3$), A-5000($5.97\times10^3$), F-1 ($1.02\times10^4$), F-2 ($1.81\times10^4$), F-4 ($3.97\times10^4$), F-10 ($9.64\times10^4$), F-20

($1.90\times10^5$), F-40 ($4.27\times10^5$), F-80 ($7.06\times10^5$), and F-128 ($1.09\times10^6$)) as standard samples.

[Amount of Heat Absorption of Components Melting at 65° C. or lower of Releasing Agent]

The amount of heat absorption is measured with a differential scanning calorimeter (commercially available from Seiko Instruments, Inc, DSC210), while heating from 20° to 200° C. at a heating rate of 10° C./min. The amount of heat absorption is obtained from a ratio of peak areas of the amount of heat absorption of a component melting at 65° C. or lower to the entire peak areas, and the entire amount of heat absorption.

[Volume-Median Particle Size ($D_{50}$) of Toner]

Measuring Apparatus Coulter Multisizer II (commercially available from Beckman Coulter, Inc.)

Aperture Diameter: 100 μm

Analyzing Software: Coulter Multisizer AccuComp Ver. 1.19 (commercially available from Beckman Coulter, Inc.)

Electrolytic solution: "Isotone II" (commercially available from Beckman Coulter, Inc.)

Dispersion: "EMULGEN 109P" (commercially available from Kao Corporation, polyoxyethylene lauryl ether, HLB: 13.6) is dissolved in the above electrolytic solution so as to have a concentration of 5% by weight to provide a dispersion.

Dispersion Conditions Ten milligrams of a measurement sample is added to 5 ml of the above dispersion, and the mixture is dispersed for 1 minute with an ultrasonic disperser, and 25 ml of the above electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size ($D_{50}$) is obtained from the particle size distribution.

apparatus (commercially available from NIPPON SHARYO LTD., MS-380) under the conditions of 0.2 Pa and 210° C. A 20% by weight portion of the entire sample was distilled off as an initial distillate, and the remainder was named Wax A. The melting point and the amount of heat absorption of components melting at a temperature of 65° C. or lower of Wax A are shown Table 1. DSC chart of the wax before distilling off the initial distillate and Wax A upon heating is shown in FIG. 1.

Production Example 2 of Wax [Wax B]

A paraffin wax having a melting point of 76° C., a normal paraffin ratio of 95%, and an amount of heat absorption of components melting at a temperature of 65° C. or lower of 9.3 J/g was distilled with a centrifugal molecular distillation apparatus (commercially available from NIPPON SHARYO LTD., MS-380) under the conditions of 0.2 Pa and 220° C. A 40% by weight portion of the entire sample was distilled off as an initial distillate, and the remainder was named Wax B. The melting point and the amount of heat absorption of components melting at a temperature of 65° C. or lower of Wax B are shown Table 1. DSC chart of Wax B upon heating is shown in FIG. 1.

Production Example 3 of Wax [Wax C]

A paraffin wax having a melting point of 73° C., a normal paraffin ratio of 93%, and an amount of heat absorption of components melting at a temperature of 65° C. or lower of 10.2 J/g was distilled with a centrifugal molecular distillation apparatus (commercially available from NIPPON SHARYO LTD., MS-380) under the conditions of 0.2 Pa and 210° C. A 40% by weight portion of the entire sample was distilled off as an initial distillate, and the remainder was named Wax C. The melting point and the amount of heat absorption of components melting at a temperature of 65° C. or lower of Wax C are shown Table 1.

The physical properties of releasing agents used in Comparative Examples are together shown in Table 1.

TABLE 1

| | Wax A | Wax B | Wax C | HNP-9 | FNP-0090 | WAX-C1 | WEP-3 |
|---|---|---|---|---|---|---|---|
| Melting Point (° C.) | 77 | 78 | 80 | 76 | 91 | 84 | 74 |
| Amount of Heat Absorption (J/g) of Component Melting at Temperature of 65° C. or Lower | 6.0 | 2.6 | 3.3 | 9.3 | 3.6 | 8.3 | 7.3 |
| Number-Average Molecular Weight | 743 | 755 | 763 | 740 | 657 | 876 | 690 |
| Weight-Average Molecular Weight | 783 | 792 | 806 | 772 | 776 | 18,008 | 768 |

Note)

HNP-9: Commercially available from NIPPON SEIRO CO., LTD., paraffin wax

FNP-0090: Commercially available from NIPPON SEIRO CO., LTD., Fischer Tropsch wax WAX-C1: Commercially available from S. Kato & CO., carnauba wax WEP-3: Commercially available from NOF Corporation, ester wax

[Average Primary Particle Size of External Additive]

Particle sizes were determined for 500 particles from a photograph taken with a scanning electron microscope (SEM), an average of length and breadth of the particles of which is taken, and the average is referred to as an average primary particle size Production Example 1 of Wax [Wax A]

A paraffin wax having a melting point of 76° C., a normal paraffin ratio of 95%, and an amount of heat absorption of components melting at a temperature of 65° C. or lower of 9.3 J/g was distilled with a centrifugal molecular distillation Production Example 1 of Resin [Resin A]

A 10-liter four-neck flask equipped with a nitrogen inlet tube, a dehydration tube, a stirrer, and a thermocouple was charged with 1286 g of polyoxypropylene(2.2)-2,2-bis(4-hydroxyphenyl)propane, 2218 g of polyethylene(2.2)-2,2-bis(4-hydroxyphenyl)propane, 1603 g of terephthalic acid, 10 g of tin(II) 2-ethylhexanoate, and 2 g of gallic acid. The components were reacted in a nitrogen atmosphere at 230° C. until a reaction percentage reached 90%, and the reaction was carried out at 8.3 kPa until a softening point reached 111° C., to provide a resin A (amorphous polyester). The resin A had a softening point of 111.4° C., a temperature of maximum endothermic peak of 71.0° C., a ratio of softening point/temperature of maximum endothermic peak of 1.6, a glass transition temperature of 68.5° C., and an acid value of 3.2 mg KOH/g. Here, the reaction percentage refers to a value calculated by [amount of water generated/theoretical amount of water generated]×100.

Production Example 2 of Resin [Resin B]

A 10-liter four-neck flask equipped with a nitrogen inlet tube, a dehydration tube, a stirrer, and a thermocouple was charged with 3486 g of polyoxypropylene(2.2)-2,2-bis(4-hydroxyphenyl)propane, 3240 g of polyoxyethylene(2.2)-2,2-bis(4-hydroxyphenyl)propane, 1881 g of terephthalic acid, 269 g of tetrapropenylsuccinic anhydride, 30 g of tin(II) 2-ethylhexanoate, and 2 g of gallic acid. The components were reacted in a nitrogen atmosphere at 230° C. until a reaction percentage reached 90%, and the reaction was carried out at 8.3 kPa for 1 hour. Next, the temperature was lowered to 220° C. and returned to normal pressure, 789 g of trimellitic anhydride was supplied thereto, and the components were reacted under the conditions of 220° C., normal pressure until a softening point reached 122° C., to provide a resin B (amorphous polyester). The resin B had a softening point of 122.2° C., a temperature of maximum endothermic peak of 65.2° C., a ratio of softening point/temperature of maximum endothermic peak of 1.9, a glass transition temperature of 63.7° C., and an acid value of 18.9 mg KOH/g.

Production Example 3 of Resin [Resin C]

A 10-liter four-neck flask equipped with a nitrogen inlet tube, a dehydration tube, a stirrer, and a thermocouple was charged with a given amount of raw material monomers for a polycondensation resin component other than acrylic acid as a dually reactive monomer, as listed in Table 2, and the components were heated to dissolve. A solution prepared by previously mixing styrene, dicumyl peroxide, and acrylic acid was added dropwise from a dropping funnel over 1 hour. The components were continued stirring for 1 hour, while keeping the temperature at 170° C., and styrene and acrylic acid were polymerized. Thereafter, 40 g of tin(II) 2-ethylhexanoate and 3 g of gallic acid were added thereto, the components were heated to 210° C., and the reaction was carried out for 8 hours. Further, the reaction was further carried out at 8.3 kPa for 1 hour, to provide a resin C (crystalline hybrid resin). The resin physical properties of the resulting resin C are shown in Table 2.

TABLE 2

| Crystalline Polyester | Resin C |
|---|---|
| Raw Material Monomers | |
| Raw Material Monomers for Polycondensation Resin Component (P)[1)] | |
| 1,6-Hexanediol | 100 (3540 g) |
| Terephthalic Acid | 78 (3884 g) |
| Acrylic Acid (Dually Reactive Monomer) | 7 (151 g) |
| Raw Material Monomers for Styrenic Resin Component (S)[2)] | |
| Styrene | 100 (1782 g) |
| Dicumyl Peroxide (Polymerization Initiator) | 6 (107 g) |
| Total Amount of P/Total Amount of S (Weight Ratio)[3)] | 81/19 |
| Number of Moles of Dually Reactive Monomer per 100 mol of Total Number of Moles of S[4)] | 12 |

TABLE 2-continued

| Crystalline Polyester | Resin C |
|---|---|
| Resin Physical Properties | |
| Glass Transition Temperature of Styrenic Resin Component According to Fox's Formula (° C.)(Tg1) | 100 |
| Glass Transition Temperature of Crystalline Polyester (° C.) (Tg2) | 16 |
| Tg1 − Tg2 | 84 |
| Softening Point (° C.) | 130 |
| Temperature of Maximum Endothermic Peak [Melting Point] (° C.) | 129 |
| Softening Point/Temperature of Maximum Endothermic Peak | 1.01 |

[1)]Numerical values show amounts (number of moles supposing that a total amount of the alcohol component is 100), and the value inside the parenthesis shows weight.
[2)]Numerical values show amounts (weight ratio supposing that a total amount of the raw material monomers for a styrenic resin component is 100), and the value inside the parenthesis shows weight.
[3)]A total amount of the raw material monomers for a styrenic resin component does not include dicumyl peroxide.
[4)]A total number of moles of the raw material monomers for a styrenic resin component does not include dicumyl peroxide.

Production Example of Resin [Resin D]

A 5-liter four-neck flask equipped with a nitrogen inlet tube, a dehydration tube, a stirrer, and a thermocouple was charged with 870 g of 1,6-hexanediol, 1575 g of 1,4-butanediol, 2950 g of fumaric acid, 2 g of hydroquinone, 40 g of tin(II) 2-ethylhexanoate, and 3 g of gallic acid. The components were reacted at 160° C. in a nitrogen atmosphere over 5 hours, the temperature was raised to 200° C., and the components were reacted for an additional 1 hour. Further, the reaction mixture reacted at 8.3 kPa until a softening point reached 110° C., to provide a resin D (crystalline polyester). The resulting resin D had a softening point of 112° C., a temperature of maximum endothermic peak of 110° C. and a ratio of [softening point/temperature of maximum endothermic peak] of 1.02.

Examples 1 to 12 and Comparative Examples 1 to 5

An amorphous resin, a crystalline polyester, and a releasing agent in given amounts listed in Table 3, 4.0 parts by weight of a colorant "ECB-301" (commercially available from DAINICHISEIKA COLOR & CHEMICALS MFG. CO., LTD., phthalocyanine blue (P.B. 15:3)), and 1.0 part by weight of a negatively chargeable charge control agent "FCA2521NJ" (commercially available from FUJIKURA KASEI CO., LTD.) were mixed with a Henschel mixer for 1 minute, and the mixture was then melt-kneaded under the following conditions.

A continuous twin open-roller type kneader "Kneadex" (commercially available from MITSUI MINING COMPANY, LIMITED, outer diameter of roller: 14 cm, effective length of roller: 80 cm) was used. The operating conditions of the continuous twin open-roller type kneader are a peripheral speed of a high-rotation roller (front roller) of 32.97 m/min, a peripheral speed of a low-rotation roller (back roller) of 21.98 m/min, and a gap between the rollers of 0.1 mm. The temperatures of the heating medium and the cooling medium inside the rollers are as follows. The high-rotation roller had a temperature at the raw material supplying side of 135° C., and a temperature at the kneaded product discharging side of 90° C., and the low-rotation roller has a temperature at the raw material supplying side of 35° C., and a temperature at the kneaded product discharging side of 35° C. In addition, the feeding rate of the raw material mixture was 4 kg/hour, and the average residence time was about 10 minutes.

The resulting melt-kneaded product was cooled to 20° C. or lower, the cooled melt-kneaded product was roughly pulverized to a size of 3 mm with Rotoplex (commercially available from TOA KIKAI SEISAKUSHO). Thereafter, the roughly pulverized product was pulverized with a fluidized bed-type jet mill "AFG-400" (commercially available from HOSOKAWA ALPINE A.G.), and the pulverized product was classified with a rotor-type classifier "TTSP" (commercially available from HOSOKAWA ALPINE A.G.), to provide toner particles having a volume-median particle size ($D_{50}$) of 6.0 μm.

To 100 parts by weight of the toner particles was added 1.5 parts by weight of a hydrophobic silica "RY50" (commercially available from Nippon Aerosil Co., Ltd., silicone oil-treated silica, average primary particle size: 40 nm), and 0.8 parts by weight of a hydrophobic silica "R972" (commercially available from Nippon Aerosil Co., Ltd., DMDS-treated silica, average primary particle size: 16 nm) with a 10-liter Henschel mixer (commercially available from MITSUI MINING COMPANY, LIMITED) at 3000 r/min (peripheral speed: 33 m/sec) for 3 minutes, to provide a toner.

TABLE 3

| | Resin Binder | | | | | |
|---|---|---|---|---|---|---|
| | Amorphous Resin | | Crystalline Polyester | | Releasing Agent | |
| | Resin A (Parts by Weight) | Resin B (Parts by Weight) | Kind | Parts by Weight | Kind | Parts by Weight |
| Ex. 1 | 60 | 30 | Resin C | 10 | Wax A | 5 |
| Ex. 2 | 60 | 30 | Resin C | 10 | Wax B | 5 |
| Ex. 3 | 60 | 30 | Resin C | 10 | Wax C | 5 |
| Ex. 4 | 60 | 30 | Resin D | 10 | Wax C | 5 |
| Ex. 5 | 60 | 40 | — | — | Wax B | 5 |
| Ex. 6 | 50 | 30 | Resin C | 20 | Wax B | 5 |
| Ex. 7 | 50 | 30 | Resin D | 20 | Wax B | 5 |
| Ex. 8 | 60 | 30 | Resin D | 10 | Wax A | 5 |
| Ex. 9 | 60 | 30 | Resin D | 10 | Wax B | 5 |
| Ex. 10 | 40 | 30 | Resin C | 30 | Wax B | 5 |
| Ex. 11 | 40 | 30 | Resin D | 30 | Wax B | 5 |
| Ex. 12 | 50 | 30 | Resin C | 20 | Wax B | 3 |
| Comp. Ex. 1 | 60 | 30 | Resin C | 10 | HNP-9 | 5 |
| Comp. Ex. 2 | 60 | 30 | Resin C | 10 | FNP-0090 | 5 |
| Comp. Ex. 3 | 60 | 30 | Resin C | 10 | WAX-C1 | 5 |
| Comp. Ex. 4 | 60 | 30 | Resin C | 10 | WEP-3 | 5 |
| Comp. Ex. 5 | 60 | 40 | — | — | HNP-9 | 5 |

Test Example 1 [Resistance to Soiling in Machine]

A nonmagnetic monocomponent development printer "C5800" (commercially available from Oki Data Corporation) according to an oil-less fusing method without a filter in a gas discharge part was placed in a chamber (inner volume W×H×D: 1000 mm×1100 mm×810 mm=0.891 $m^3$). While printing at a print coverage of 5% for 2 hours, the scattered fine powder (dust) was captured with a glass fiber filter (manufactured by Pall Corporation, A/E type, 47 mm diameter, pore size 1 μm) under the conditions of aspirating the air in the chamber with a pump at a rate of 50 L/minute/$cm^2$, and the weight of the dust was measured to calculate an amount scattered (mg/h) per hour. The results are shown in Table 4. The smaller the value, the more excellent the resistance to soiling in the machine.

Test Example 2 [Low-Temperature Fixing Ability]

Each of the toners was loaded in a nonmagnetic monocomponent developer device "OKI MICROLINE 5400" (commercially available from Oki Data Corporation). With adjusting the amount of toner adhesion to 0.50 mg±0.05 mg/$cm^2$, a solid image of 3 cm×8 cm was printed on Xerox L sheet (A4), commercially available from FUJI XEROX CO., LTD. The solid image was taken out before passing through a fixing device, to provide an unfixed image.

The resulting unfixed image was fixed with an external fixing device, which was a fixing device taken out of "OKI MICROLINE 3050" (commercially available from Oki Data Corporation), while setting the temperature of the fixing roller to 180° C. and a fixing speed to 300 mm/sec. Thereafter, the same procedures were carried out with setting the fixing roller temperature at 175° C., and the procedures were repeated while decrementing the temperature by 5° C. until a fixing strength shown below was less than 70%.

Mending tape (commercially available from SUMITOMO 3M LIMITED) was adhered to fixed images fixed at each temperature, and a 500 g weight having a cylindrical shape was placed over the mending tape, so that the tape was sufficiently adhered to the fixed images. Thereafter, the mending tape was gently removed from the fixed images, and the optical reflective density of the fixed images after the tape removal was measured with a reflective densitometer "RD-915" (commercially available from X-Rite GmbH). The optical reflective density of the fixed images before adhering the tape was previously measured, and a temperature 5° C. above a temperature of a fixing roller at which a ratio of the values (after tape removal/before tape adhesion) is initially less than 70% is defined as a lowest fixing temperature, and lowest fixing ability was evaluated. The results are shown in Table 4. The smaller the value, the more excellent the low-temperature fixing ability.

Test Example 3 [High-Temperature Offset Resistance]

Each of the toners was loaded in a nonmagnetic monocomponent developer device "OKI MICROLINE 5400" (commercially available from Oki Data Corporation). With adjusting the amount of toner adhesion to 1.00 mg±0.05 mg/$cm^2$, a solid image of 3 cm×8 cm was printed on Xerox L sheet (A4), commercially available from FUJI XEROX CO., LTD. The solid image was taken out before passing through a fixing device, to provide an unfixed image.

The resulting unfixed image was fixed with an external fixing device, which was a fixing device taken out of "OKI MICROLINE 3050" (commercially available from Oki Data Corporation), while setting the temperature of the fixing roller to 140° C. and a fixing speed to 120 mm/sec. Thereafter, the same procedures were carried out with setting the fixing roller temperature at 145° C., and the procedures were repeated while incrementing the temperature by 5° C. up to 190° C.

The fixed images fixed at each temperature were visually confirmed, and a highest temperature of the fixing roller at which offset images of the solid image were not generated at the bottom of the paper sheet is defined as a highest fixing temperature, and high-temperature offset resistance was evaluated. The results are shown in Table 4. The larger the value, the more excellent the high-temperature offset resistance.

Test Example 4 [Background Fogging]

Each of the toners was loaded in a nonmagnetic monocomponent developer device "OKI MICROLINE 5400" (commercially available from Oki Data Corporation), and allowed to stand under environmental conditions of 25° C. and 50% RH, and white sheets with 0% print coverage was then printed. Thereafter, toner remaining on a photoconductor drum was adhered to a mending tape, the coloration density was measured with a color-and-colorimeter "X-Rite" (commercially available from X-Rite GmbH), and a difference in coloration densities from that of the mending tape before the adhesion of the toner was obtained. The results are shown in Table 4. The smaller the value, the more suppressed the background fogging.

[Table 4]

TABLE 4

| | Physical Properties of Releasing Agent | | Evaluations on Toner Properties | | | |
|---|---|---|---|---|---|---|
| | Melting Point (° C.) | Amount of Heat Absorption (J/g) of Component Melting at 65° C. or Lower | Resistance to Soiling in Machine [Amount Scattered (mg/h)] | Low-Temperature Fixing Ability [Lowest Fixing Temperature (° C.)] | High-Temperature Offset Resistance [Highest Fixing Temperature (° C.)] | Background Fogging |
| Ex. 1 | 77 | 6.0 | 0.9 | 150 | >190 | 0.9 |
| Ex. 2 | 78 | 2.6 | 0.6 | 150 | >190 | 0.5 |
| Ex. 3 | 80 | 3.3 | 0.6 | 150 | >190 | 0.7 |
| Ex. 4 | 80 | 3.3 | 0.6 | 145 | 190 | 1.0 |
| Ex. 5 | 78 | 2.6 | 0.9 | 170 | >190 | 0.8 |
| Ex. 6 | 78 | 2.6 | 0.3 | 140 | >190 | 0.7 |
| Ex. 7 | 78 | 2.6 | 0.5 | 140 | 190 | 1.1 |
| Ex. 8 | 77 | 6.0 | 1.1 | 150 | >190 | 1.3 |
| Ex. 9 | 78 | 2.6 | 0.7 | 145 | >190 | 0.9 |
| Ex. 10 | 78 | 2.6 | 0.2 | 135 | 190 | 1.0 |
| Ex. 11 | 78 | 2.6 | 0.3 | 135 | 185 | 1.2 |
| Ex. 12 | 78 | 2.6 | 0.2 | 140 | 180 | 0.6 |
| Comp. Ex. 1 | 76 | 9.3 | 2.1 | 150 | >190 | 1.5 |
| Comp. Ex. 2 | 91 | 3.6 | 0.5 | 165 | 170 | 0.8 |
| Comp. Ex. 3 | 84 | 8.3 | 1.3 | 160 | 165 | 0.7 |
| Comp. Ex. 4 | 74 | 7.3 | 0.8 | 160 | 170 | 0.8 |
| Comp. Ex. 5 | 76 | 9.3 | 2.8 | 170 | >190 | 2.2 |

It can be seen from the above results that the toners of Examples 1 to 12 have excellent resistance to soiling in the machine, background fogging, low-temperature fixing ability, and high-temperature offset resistance, as compared to the toners of Comparative Examples 1 to 5. In addition, it can be seen that the toners of Examples 1 to 4, and 6 to 12, each containing a crystalline polyester have excellent resistance to soiling in the machine and low-temperature fixing ability. It can be seen that the toners of Examples 6, 7 and 10 to 12 containing a large amount of the crystalline polyester have excellent resistance to soiling in the machine, and that the toners of Examples 6, 10 and 12 containing a composite resin (crystalline polyester A) have even more excellent resistance to soiling in the machine.

INDUSTRIAL APPLICABILITY

The method for forming fixed images of the present invention is suitably used in the development of a latent image formed in, for example, electrophotography, electrostatic recording method, electrostatic printing method or the like.

The invention claimed is:

1. A method for forming fixed images comprising applying a toner for electrostatic image development comprising at least a resin binder, a colorant, and a releasing agent to an apparatus for forming fixed images without a filter in a gas discharge part, wherein the resin binder comprises a polyester, and wherein the releasing agent is a hydrocarbon-based wax, wherein the hydrocarbon-based wax has a melting point as determined by a differential scanning calorimeter of from 70° to 85° C., and comprises components melting at a temperature equal to or lower than 65° C. having an amount of heat absorption as determined by a differential scanning calorimeter of less than 7.5 J/g.

2. The method according to claim 1, wherein the resin binder comprises a crystalline polyester and an amorphous polyester.

3. The method according to claim 2, wherein the crystalline polyester comprises a crystalline composite resin comprising a polycondensation resin component obtained by polycondensing an alcohol component comprising an aliphatic diol having 2 to 10 carbon atoms and a carboxylic acid component comprising an aromatic dicarboxylic acid compound, and a styrenic resin component.

4. The method according to claim 3, wherein the composite resin is a resin obtained by polymerizing (i) raw material monomers for a polycondensation resin component, comprising an alcohol component comprising an aliphatic diol having 2 to 10 carbon atoms and a carboxylic acid component comprising an aromatic dicarboxylic acid compound; (ii) raw material monomers for a styrenic resin component; and (iii) a dually reactive monomer capable of reacting with both of the raw material monomers for the polycondensation resin component and the raw material monomers for the styrenic resin component.

5. The method according to claim 3, wherein the composite resin is present in an amount of 80% by weight or more, of the crystalline polyester.

6. The method according to claim 2, wherein the crystalline polyester is contained in an amount of from 5 to 40% by weight of the resin binder.

7. The method according to claim 2, wherein the crystalline polyester is present in an amount of from 10% by weight to 30% by weight, of the resin binder.

8. The method according to claim 2, wherein the crystalline polyester has a melting point of from 80° C. to 160° C.

9. The method according to claim 2, wherein the crystalline polyester and the amorphous polyester are present in a weight ratio, i.e. the crystalline polyester/the amorphous polyester, of from 5/95 to 50/50.

10. The method according to claim 1, wherein the apparatus for forming fixed images is an apparatus for forming fixed images according to an oilless fusing method and a nonmagnetic monocomponent development method.

11. The method according to claim 1, wherein the amount of heat absorption of the components melting at a temperature equal to or lower than 65° C. of the hydrocarbon-based wax is 4.0 j/g or less.

12. The method according to claim 1, wherein the hydrocarbon-based wax has a melting point of from 75° C. to 80° C.

13. The method according to claim 1, wherein the hydrocarbon-based wax has a weight-average molecular weight of from 700 to 900.

14. The method according to claim 1, wherein the hydrocarbon-based wax is present in the toner in an amount of from 1.0 part by weight to 8.0 parts by weight, based on 100 parts by weight of the resin binder.

15. A toner for electrostatic image development comprising at least a resin binder, a colorant, and a releasing agent, wherein the resin binder comprises a crystalline polyester and an amorphous polyester, and wherein the releasing agent is a hydrocarbon-based wax, wherein the hydrocarbon-based wax has a melting point as determined by a differential scanning calorimeter of from 70° to 85° C., and comprises components melting at a temperature equal to or lower than 65° C. having an amount of heat absorption as determined by a differential scanning calorimeter of less than 7.5 J/g, wherein the toner is applied to an apparatus for forming fixed images without a filter in a gas discharge part.

16. The toner according to claim 15, wherein the crystalline polyester and the amorphous polyester are present in a weight ratio, i.e. the crystalline polyester/the amorphous polyester, of from 5/95 to 50/50.

17. The toner according to claim 15, wherein the hydrocarbon-based wax has a melting point of from 75° C. to 80° C.

18. The toner according to claim 15, wherein the hydrocarbon-based wax is present in the toner in an amount of from 1.0 part by weight to 8.0 parts by weight, based on 100 parts by weight of the resin binder.

19. The toner according to claim 15, wherein the crystalline polyester comprises a crystalline composite resin comprising a polycondensation resin component obtained by polycondensing an alcohol component comprising an aliphatic diol having 2 to 10 carbon atoms and a carboxylic acid component comprising an aromatic dicarboxylic acid compound, and a styrenic resin component.

20. A method for forming fixed images comprising applying a toner for electrostatic image development comprising at least a resin binder, a colorant, and a releasing agent to an apparatus for forming fixed images according to an oilless fusing method and a nonmagnetic monocomponent development method, the apparatus being without a filter in a gas discharge part, wherein the resin binder comprises a crystalline polyester and an amorphous polyester, wherein the crystalline polyester is present in an amount of from 15% by weight to 30% by weight, of the resin binder, and wherein the releasing agent is a hydrocarbon-based wax, wherein the hydrocarbon-based wax has a melting point as determined by a differential scanning calorimeter of from 70° C. to 85° C., and comprises components melting at a temperature equal to or lower than 65° C. having an amount of heat absorption as determined by a differential scanning calorimeter of 4.0 J/g or less.

* * * * *